US006276121B1

(12) United States Patent
Nabeshima et al.

(10) Patent No.: US 6,276,121 B1
(45) **Date of Patent: *Aug. 21, 2001**

(54) CRIMPED YARN, TEXTILE FABRIC, AND PROCESS FOR PREPARING THE SAME

(75) Inventors: Keitaro Nabeshima; Katsushige Wanibe; Ryosuke Chono, all of Shiga; Hiroaki Tatsumi, Shizuoka; Tatsuaki Matsuda, Ishikawa; Tsukasa Shiba, Osaka, all of (JP)

(73) Assignee: Toray Industries, Inc. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/194,532

(22) PCT Filed: Mar. 30, 1998

(86) PCT No.: PCT/JP98/01442

§ 371 Date: Nov. 25, 1998

§ 102(e) Date: Nov. 25, 1998

(87) PCT Pub. No.: WO98/44178

PCT Pub. Date: Oct. 8, 1998

(30) Foreign Application Priority Data

Mar. 31, 1997 (JP) ..... 9-098044
Apr. 15, 1997 (JP) ..... 9-114372

(51) Int. Cl.[7] ..... D02G 13/02

(52) U.S. Cl. ..... 57/245; 57/247; 57/246

(58) Field of Search ..... 57/238, 205, 208, 57/227, 246, 247, 284, 351, 245

(56) References Cited

U.S. PATENT DOCUMENTS 4,307,565 * 12/1981 Sasaki et al. ..... 57/205
5,307,614 * 5/1994 Nabeshima et al. ..... 57/207
5,422,171 * 6/1995 Nabeshima et al. ..... 428/229
5,459,991 * 10/1995 Nabeshima ..... 57/287

FOREIGN PATENT DOCUMENTS 49-68009 * 7/1974 (JP) .
19-124333 * 11/1974 (JP) .
50-3418 * 2/1975 (JP) .
51-37376 10/1976 (JP) .
55-40831 * 3/1980 (JP) .
57-25650 5/1982 (JP) .

(List continued on next page.)

*Primary Examiner*—Danny Worrell
(74) *Attorney, Agent, or Firm*—Schnader Harrison Segal & Lewis LLP

(57) ABSTRACT

Crimped yarns that comprise a conjugate multifilament yarn having unique surface texture, dry touch, and stretchability; woven/knitted products comprising said crimped yarn; and production methods of crimped yarn as a conjugate multifilament yarn comprising polyester polymer components and has (a) number of crimps (CA): 2.5 crests/cm≦CA≦10 crests/cm, (b) number of developed crimps (CB): 8 crests/cm≦CB≦30 crests/cm, (c) shrinkage stress (TS): 0.0882≦TS (cN/dtex)≦0.221, (d) apparent shrinkage percentage (SC): 40%≦SC≦80%, and (e) shrinkage percentage of fiber in boiling water (SW): 2%≦SW≦8%, and produced by subjecting a crimp-forming conjugate multifilament yarn to relaxation-heat treatment.

27 Claims, 6 Drawing Sheets

FOREIGN PATENT DOCUMENTS

| | | | |
|---|---|---|---|
| 62-85048 | | 4/1987 | (JP) . |
| 4-289219 | | 10/1992 | (JP) . |
| 4-308271 | | 10/1992 | (JP) . |
| 5-132856 | | 5/1993 | (JP) . |
| 5-247757 | * | 9/1993 | (JP) . |
| 5-295634 | | 11/1993 | (JP) . |
| 5-295670 | | 11/1993 | (JP) . |
| 6-57622 | | 3/1994 | (JP) . |
| 6-108357 | | 4/1994 | (JP) . |
| 6-108358 | | 4/1994 | (JP) . |
| 6-322661 | | 11/1994 | (JP) . |
| 8-170248 | * | 2/1996 | (JP) . |
| 8-41752 | * | 2/1996 | (JP) . |
| 8-296136 | * | 11/1996 | (JP) . |

* cited by examiner

PRIOR ART

CRIMPED YARN, TEXTILE FABRIC, AND PROCESS FOR PREPARING THE SAME

TECHNICAL FIELD

The present invention relates to a crimp-forming conjugate multifilament yarn comprising multifilament having at least two polyester components with different heat-shrinking properties, said components being combined in parallel with each other or in a core-sheath configuration, and said yarn being able to produce woven/knitted products having unique surface texture and stretchability; production methods thereof; and woven/knitted products produced from said crimp-forming conjugate multifilament yarn that have, in particular, novel, unique surface texture, dry touch, and stretchability as well as excellent puffiness and anti-see-through.

The invention also relates to woven/knitted products with lightweight properties, stretchability, and high resilience, wherein the multifilament yarn that constitutes said woven/knitted products comprises an aggregate of filaments, each having a hollow structure with voids oriented in the yarn's length direction.

The invention further relates to a composite yarn with hari (anti-drape stiffness), koshi (moderate stiffness), and soft puffiness as well as stretchability, and woven/knitted products produced thereof.

BACKGROUND ART

With many good properties, the polyester fiber has conventionally been one of the most widely used synthetic fibers, and in recent years, in particular, efforts in the apparel industry have resulted in the development of modified or improved materials with excellent feel, which are generally called "new synthetic fibers". These "new synthetic fibers" have been accepted in the market because of their novel excellent texture, totally different from other conventional materials, which has been achieved by a polyester fiber production method that combines an advanced technique to produce raw thread and a high-level processing step to manufacture a woven/knitted product. These "new synthetic fibers" with excellent texture, however, have some problems in terms of costs and quality stability because they need a complicated combination of an advanced raw thread production technique and a high-level processing step. In particular, several types of raw threads have to be subjected to false twisting and filament-combining to achieve the new feature of excellent texture, and furthermore union-twisting and union weaving may be carried out to achieve high value added, which leads to very high prices. After a series of similar products has been placed on the market, consumers now tend to call for products with different texture, resulting in demand for further improvements in terms of appearance and functional properties.

To solve these problems, a woven/knitted product with surface variations, for example, can be produced by twisting and false twisting. This method, however, requires large costs and has difficulty in achieving a novel surface texture. In addition, the necessity of false twisting makes it impossible to produce a stretchable woven/knitted product. Some techniques, including the use of polyurethane-based elastic fiber, are available to impart stretchability to a woven/knitted product, but they require large costs and cannot produce products with a novel surface texture. There are some known techniques in which knitted products with surface variations are produced by using a conjugate yarn consisting of two different polymer components aligned side by side. In some efforts, furthermore, such products are false-twisted to achieve stretchability. These techniques, however, require many processes that need large costs, and resultant products tend to suffer from a poor hand.

Japanese patent publications JP-B51-37376 and JP-B57-25650 have proposed methods for producing bulky yarn, bulky woven products, and bulky knitted products, in which an extended conjugate yarn consisting of polyethylene terephthalate and copolyester is subjected to relaxation-heat treatment under very small tension to achieve crimping. Though able to achieve crimping stably, these techniques have been found to have difficulty in providing woven/knitted products with surface variations and stretchability.

When such conventional fabric is produced using a shrinkable straight thread as raw material, the resultant product has no surface variations and no stretchability. If said straight thread is subjected to addition of twist and used to produce a woven/knitted product, surface variations can be developed by heating the product to form wrinkles due to the effect of untwisting torque, but it is still difficult to make it stretchable. Though actually having crimps, conventional false-twisted yarn has no ability to develop additional crimps over the existing ones. In the case of false-twisted yarn, furthermore, the crimps are too fine, and are not aligned in phase. As a result, such fabric can be bulky and less transparent, but cannot have sufficient surface variations or stretchability.

The conventionally known technique that uses a conjugate yarn consisting of two polyester polymer components with different heat-shrinking properties combined in parallel with each other or in a core-sheath configuration can produce a woven/knitted product in which a certain degree of stretchability develops in some structural portions where restraining force is small. However, when the yarn is in the form of an aggregate of filaments, the resultant fiber can be shrunk, but will be poor in the ability to develop crimps after overcoming the restraining force of the structures in the woven/knitted product. As in the case of conventional material produced from a single-component polyester multifilament yarn, said product suffers from transparency and poor bulkiness, and does not have surface variations. Thus, the present inventors carried out earnest studies to develop a method to produce a woven/knitted product with both surface variations and stretchability, and achieved the present invention after finding that a desired woven/knitted product can be produced by starting with a material with half-developed crimps, which is prepared by providing latent crimps at floated portions around the intersections of warp and weft in a woven product or in the loops in a knitted product, followed by allowing the latent crimps to develop into full ones.

There is also increased demand for woven/knitted products that are produced from synthetic products and have such features as resilience as well as lightweight properties and stretchability which are not found in most natural fiber products. A solution to this is proposed in Japanese patent publication JP-A5-247757, but it is difficult to produce lightweight products because the crimps in the filaments developed by crimping and false twisting of conjugate fiber are not aligned in phase, making it difficult to allow large voids to develop. To provide lightweight products, Japanese patent publications JP-A62-85048 and JP-A4-289219 have proposed the use of hollow fiber. In this technique, the hollow proportion of the hollow fiber is the key factor to weight reduction. If the hollow proportion in the hollow fiber is increased, however, the diameter of the fiber has also to be increased to allow high-level processing to be performed effectively. For instance, false twisting performed to enhance the stretchability can result in squashing of hollow parts, or breakage of hollow parts while the clothing product is worn. Thus, it has been widely thought that with the conventional techniques, it is difficult to produce products with both stretchability and lightweight properties at reduced processing costs.

In another existing technique, several different raw threads are used to develop novel effects in woven/knitted products, and composite false twisting and composite combined filament processing are carried out to develop additional valuable properties. This technique, however, tends to require very large electric power costs for false twisting and air processing.

Such additional costs required for composite processing can be absorbed in the case of such thick fabric products as suits and coats that sell at relatively high prices. In the case of such thin fabric products as blouses and shirts that cannot sell at high prices, the additional costs cannot be absorbed, so it is important to minimize the processing costs. To develop a woven product with value added, on the other hand, it is important to use several different threads as composite yarn to achieve a synergistic effect, and development efforts have been made to provide techniques to reduce the costs required for composite processing.

In another proposed technique that uses a false-twisted composite yarn to enhance its value, a two- or multiple-layer structure is formed to contribute to imparting novel texture as well as stretchability as a functional property. Japanese patent publication JP-A5-247757 proposes subjecting a polyester conjugate yarn to false twisting and crimping first, followed by a filament-combining process. This technique, however, requires large costs for an increased number of processes for false twisting and air filament-combining, and resulting products tend to be poor in hand.

DISCLOSURE OF THE INVENTION

The present invention is the result of earnest studies that aimed to free ourselves from fixed ideas in solving the problems with conventional products and methods.

The objective of the invention is to provide a crimped yarn that is produced from a crimp-forming conjugate multifilament yarn and that can produce woven/knitted products with unique surface texture, dry touch, and stretchability, and to provide woven/knitted products with excellent puffiness and anti-see-through as well as novel, unique surface texture, dry touch, and stretchability.

The invention also aims to provide crimped yarn production methods whereby a raw yarn that can impart a novel surface texture and stretchability to said woven/knitted products is produced at reasonable costs.

The invention also aims to provide woven/knitted products comprising hollow structures, said hollow structures consisting of void-like hollow parts produced from aggregates of filaments, rather than consisting of so-called hollow fiber in which the fiber itself contains hollow structures, and said woven/knitted products having both lightweight properties and stretchability that results from the flexibility of the spiral aggregates.

The invention still further aims to provide a composite yarn with hari (anti-drape stiffness), koshi (moderate stiffness), soft puffiness, lightweight properties, and stretchability, and woven/knitted products produced from said composite yarn.

Other objectives of the invention should be understood from the description given below.

The present invention intends to achieve the above-mentioned objectives. What is claimed in is a crimped yarn comprising a crimp-forming conjugate multifilament yarn wherein at least two polyester components having different heat-shrinking properties are combined in parallel with each other or in a core-sheath configuration, said crimped yarn having characteristics that meet the following equations:

(a) 2.5 crests/cm≦number of crimps (CA)≦10 crests/cm.

(b) 8 crests/cm≦number of additionally developed crimps (CB)≦30 crests/cm.

For the present invention, said conjugate multifilament yarn should preferably have characteristics that meet the following equations.

(c) 0.0882≦shrinkage stress (TS) (cN/dtex)≦0.221.

(d) 40%≦apparent shrinkage percentage (SC)≦80%.

(e) 2%≦shrinkage percentage of fiber in boiling water (SW)≦8%.

To produce a crimped yarn with said characteristics, a crimp-forming conjugate multifilament yarn is formed wherein at least two polyester components with different heat-shrinking properties are combined in parallel with each other or in a core-sheath configuration, and, the resulting crimp-forming conjugate multifilament yarn is then subjected to relaxation-heat treatment.

The present invention also provides woven/knitted products with dry touch and stretchability that are produced by knitting or weaving said crimped yarn. As preferred embodiments of the invention, said woven/knitted products should preferably comprise a crimp-forming conjugate multifilament yarn with a fineness of 30–350 dtex, said crimp-forming conjugate multifilament yarn accounting for 35 wt % or more of the entire yarn components, crimps being formed by heat treatment for shrinking up to 10–60% in the transverse direction and the machine direction, and the crimps thus formed comprising aggregates of twisted spiral filaments having hollow structures at their center.

This invention includes woven/knitted products produced from hollow threads wherein the multifilament yarn that constitutes said hollow threads comprises an aggregate of twisted spiral filaments, with the central portion having a hollow structure. As a preferred embodiment of the invention, said multifilament yarn should be a conjugate multifilament yarn produced by developing the crimps in a crimp-forming conjugate multifilament yarn, said multifilament yarn comprising hollow threads, and said multifilament yarn being twisted up to a twist coefficient, a, in the range of 3,000–30,000. This invention further includes is a composite yarn comprising a crimp-forming conjugate multifilament yarn A that consists of at least two polyester components with different heat-shrinking properties and another polyester filament yarn B, said thread A and thread B being twisted together. As a preferred embodiment of the invention, said other polyester filament yarn B should be a false-twisted polyester filament yarn, and said composite yarn should be twisted in the opposite direction to the direction of torque of said false-twisted polyester filament yarn B.

As another preferred embodiment of the invention, furthermore, said composite yarn should be twisted up to a twist coefficient, $\alpha$, of 3,000–25,000, preferably 3,000–20,000, the central portion of said composite yarn having a hollow structure, said conjugate multifilament yarn A having a fineness of 30–350 dtex, said other polyester filament thread having a fineness of 30–800 dtex, and the weight of said crimp-forming conjugate multifilament yarn A, and the weight of said other polyester filament yarn B meeting the equation $0.2 \leqq A/(A+B) \leqq 0.8$.

As yet another preferred embodiment of the invention, furthermore, the number of additionally developed crimps (CB) and the shrinkage stress (TS) of said crimp forming conjugate multifilament yarn A should meet the equations:

$8 \leqq CB$ (crests/cm) $\leqq 30$, and

TS (g) $\geqq 0.265$ cN/dtex, and said composite yarn should be heat-treated to allow crimps to develop.

In addition, the present invention provides woven/knitted products with hari (anti-drape stiffness), koshi (moderate stiffness), soft puffiness, lightweight properties, and stretchability.

BRIEF DESCRIPTION OF THE DRAWINGS

FIG. 1 illustrates the three-dimensional form of a spiral coiling conjugate multifilament yarn that is produced by spinning and extension and has forming ability, (a) and (b) showing a multifilament yarn and a single filament that constitutes the multifilament yarn, respectively.

FIG. 2 illustrates the structure of the self-crimped yarn of the present invention, (a) and (b) showing a multifilament yarn and a single filament that constitutes the multifilament yarn, respectively.

FIG. 3 shows the cross-section of a weft of a fabric produced in an example of the present invention.

FIG. 4 is a magnified photograph of the multifilament aggregate in FIG. 1 which has a hollow structure with a void at the center.

FIG. 5 is a lateral photograph of the twisted structure of a multifilament yarn illustrating its hollow state.

FIG. 6 is a magnified photograph illustrating a key portion of the photograph of FIG. 5.

FIG. 7 is a photograph illustrating the fiber in the lateral side of the composite yarn produced in Example 12, which is described below to illustrate the invention.

FIG. 8 is a photograph illustrating the fiber in the cross-section of the composite yarn produced in Example 12, which is described below to illustrate the invention.

FIG. 9 is a photograph illustrating the fiber in the crimped composite yarn of the invention produced in Example 15, which is twisted in the opposite direction to the direction of torque of the false-twisted thread used.

FIG. 10 is a photograph illustrating the fiber in the crimped composite yarn of the invention produced in Example 16, which is twisted in the same direction as the direction of torque of the false-twisted thread used.

THE BEST EMBODIMENTS OF THE INVENTION

Figure 1A:
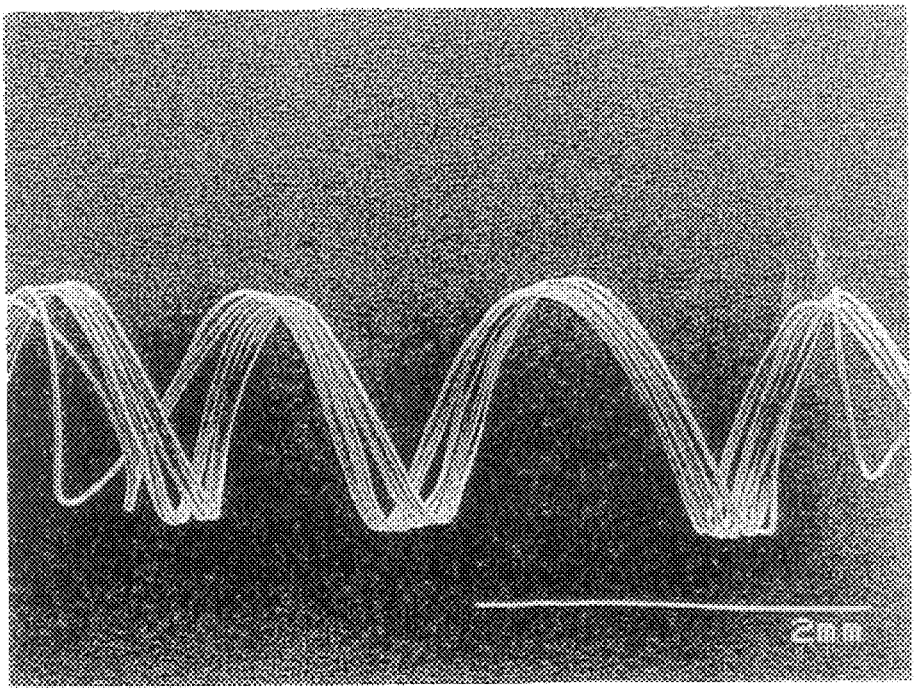
FIGS. 1–10 are microphotographs which serve as substitutes for drawings.

The present invention comprises a crimp-forming conjugate multifilament yarn that comprises at least two polyester components having different heat-shrinking properties combined in parallel with each other or in a core-sheath configuration. Said crimp-forming conjugate multifilament yarn is a multifilament yarn wherein crimps can be developed by making use of said difference in heat-shrinking properties, said multifilament yarn being subjected to relaxation-heat treatment before being processed into a woven/knitted product, and crimps having been formed with a latent crimp-forming ability remaining viable. This differs from a multifilament yarn that has a crimp structure developed by false twisting or other yarn processing techniques. Preferably, the multifilament yarn should be heat-set. In other words, the crimp-forming conjugate filament polyester of the present invention has a latent ability to develop crimps by making use of a difference in heat-shrinking properties, and as a result of boiling water treatment, crimps are developed by making use of this latent crimp-forming ability.

In the present invention, said crimp-forming conjugate filament yarn is a polyester filament yarn wherein the main repeating unit is ethylene terephthalate, and normally, two polyester components having different heat-shrinking properties are used. Said polyester components having different heat-shrinking properties include polyester homopolymers with different polymerization degrees, polyester copolymerized with a third component other than the terephthalic acid component and/or ethylene glycol component, and polyester blended with other polymers.

Specifically, said polyester components with different heat-shrinking properties as used in the present invention should preferably be polyethylene terephthalate or copolyester containing 80 mol % or more of ethylene terephthalate units. The copolymerization units in said copolyester may be such known ones as isophthalic acids, isophthalic acids with a metal sulfonate group, bisphenols, neopentyl glycols, and 1,6-cyclohexanediols. Said polyester may contain a delustering agent, ultraviolet absorbing agent, improving component with dyeing ability, pigment, or other modifiers.

In the crimped yarn of the invention, the number of crimps in the length direction of the multifilament, CA, is 2.5–10 crests/cm, preferably 3.5–7.5 crests/cm, and the number of latent crimps that are developed by boiling water treatment, CB, is 8–30 crests/cm, preferably 13–27 crests/cm.

Generally, a woven or knitted product has structural portions with different restraining forces as a result of component threads mingled with each other. Specifically, in a woven product, the restraining force is strong at the intersections of warp and weft while it is weak in other portions where threads run individually. In a knitted product, which consists of needle loops and sinker loops, the restraining force is strong at the intersections of loops while each loop does not have a strong restraining force.

When such conventional fabric is produced using a shrinkable straight thread as raw material, the resultant product has no surface variations and no stretchability. If said straight thread is subjected to additional twisting and used to produce a woven/knitted product, surface variations can be developed by heating the product to form wrinkles due to the effect of untwisting torque, but it is still difficult to make it stretchable. Though actually having crimps, conventional false-twisted yarn has no ability to develop additional crimps over the existing ones, and thus it is difficult to impart surface variations and stretchability.

The conventionally known technique that uses a conjugate yarn consisting of two polyester polymer components with different heat-shrinking properties combined in parallel with each other or in a core-sheath configuration can produce a woven/knitted product with stretchability, but it is impossible to impart surface variations.

Thus, the present inventors carried out earnest studies to develop a method to produce a woven/knitted product with both surface variations and stretchability, and found that a desired woven/knitted product can be produced by starting with material with half-developed crimps, which is prepared by providing latent crimps at floated portions where restraining forces are not exerted from the intersections of warp and weft in a woven product or in the loops in a knitted product, followed by allowing the latent crimps to develop into full ones.

Details of raw threads with half-developed crimps, which comprise fully developed crimps and latent crimps, are described below. As a basic feature, it is important that the number of full crimps in the raw thread, CA, is 2.5–10 crests/cm while the number of latent crimps that develop into full ones in a free state under boiling water treatment, CB, is 8–30 crests/cm. This crimp developing ability allows crimps to be formed under restraining forces in the woven or knitted structures. As a preferred feature for this, the raw threads should have a shrinkage stress, TS, in the range of $0.0882 \leqq TS$ (cN/dtex)$\leqq 0.221$, shrinkage percentage in boiling water, SW, in the range of 2%–8%, and the apparent shrinkage percentage, SC, i.e., the shrinkage percentage caused by crimp development under boiling water treatment in a free state, in the range of 40%–80%. Methods to determine the above-mentioned characteristics are described below.

(1) Number of crimps in raw thread, CA (crests/cm).

A multifilament yarn is cut into pieces of 70 mm or more (favorable length for measuring), and one of the pieces is placed on a glass plate. The numbers of crests and bottoms existing in a 1 cm length are counted, and the total number is divided by two. Measurements are made for ten pieces and the average is calculated.

(2) Number of latent crimps, CB (crests/cm).

A multifilament yarn is treated in boiling water for 15 min, followed by immersion in cold water for 1 min. After being dried in air, the yarn is placed on a glass plate, and projected on a screen using a projector. The numbers of crests and bottoms existing in a 1 cm length are counted, and the total number is divided by two. Measurements are made for ten samples and the average is calculated.

(3) Shrinkage stress, TS (g).

A sample is heated from room temperature up to around 250° C. while the change in shrinkage stress is detected with a U gauge (strain gauge) and recorded on an X-Y recorder. The measuring conditions should include a sample length of 100 mm, heating rate of 2.5° C./sec, and initial weight of 0.0882 cN/dtex×2 g. The maximum stress (g) and peak temperature (°C.) are determined from the chart.

(4) Apparent shrinkage percentage, SC (%).

A sizing reel with a circumference of 1.25 m is used to prepare a hank of ten turns, and a weight of (0.000882 cN/dtex×10×2) g is applied, followed by measuring the length (a). The hank is treated in boiling water for 15 min, and immersed in cold water for 1 min, air-dried, and measured under a weight of (0.000882 cN/dtex×10×2) g to determine the length (b). The apparent shrinkage percentage is calculated by the equation SC (%)=(a−b)/a×100.

(5) Shrinkage percentage in boiling water, SW (%).

A sample is prepared by the same procedure as for apparent shrinkage percentage measurement. A weight of (0.176 cN/dtex×10×2) g is applied and the length (a) is measured. The sample is treated in boiling water for 15 min, and left to cool, and measured under a weight of (0.176 cN/dtex×10×2) g to determine the length (b). The shrinkage percentage in boiling water is calculated by the equation SW (%)=(a−b)/a×100.

A raw thread with said features can be produced by combining at least two polyester polymer components with different heat-shrinking properties in parallel with each other into a composite structure, or by putting a core component in a sheath component in an eccentric arrangement, the resulting product then being subjected to heat treatment under certain conditions after spinning and drawing. Specifically, a multifilament yarn having a shrinkage stress that acts to develop three-dimensional crimps is subjected to relaxation-heat treatment to allow part of the crimps to develop under conditions where the shrinkage stress will not be relieved completely.

A preferred polyester polymer comprising two components with different heat-shrinking properties for the present invention includes a polyester polymer consisting of a low-viscosity polyester component and a high-viscosity polyester component. Specifically, when homopolyesters are used, said low-viscosity polyester component should have an intrinsic viscosity in the range of 0.35 to 0.45 while said high-viscosity polyester component should have an intrinsic viscosity in the range of 0.65 to 0.85. If the intrinsic viscosity of the low-viscosity polyester component is too low, the melt viscosity will be too low, making it difficult to perform spinning. If the intrinsic viscosity of the low-viscosity polyester component is too high, the conjugate multifilament yarn will be too poor in crimp developing ability, and both the ability of accommodating half-developed crimps and the ability of fully developing latent crimps will decline. If the intrinsic viscosity of the high-viscosity polyester component is too high, the melt viscosity will be too high, making it difficult to perform spinning and drawing. If the intrinsic viscosity of the high-viscosity polyester component is too low, the crimp developing ability will decline.

The difference in intrinsic viscosity between the low-viscosity polyester component and the high-viscosity polyester component should be in the range of 0.20 to 0.40. If a copolyester is used as one of the components, the difference between the two components can be smaller. The intrinsic viscosity used here is measured for an ortho-chlorophenol solution at 25° C.

The composition of said conjugate multifilament yarn comprising a low-viscosity polyester component and a high-viscosity polyester component should be 35–50 vs. 65–50% by weight, more preferably 40–50 vs. 60–50. If the composition is out of these ranges, the ability of accommodating half-developed crimps and the ability of fully developing latent crimps will decline, and the effect of the present invention will not be achieved.

The shape of the cross-section of fiber should most preferably be circular, but may be in other forms including triangle to octagon. Production methods for said crimped yarn of the present invention are described below.

The characteristic crimped yarn of the present invention can be produced by spinning a polyester polymer comprising two components with different shrinking properties from one nozzle in parallel with each other or in a core-sheath combination, followed by drawing, and subjecting the resulting drawn yarn to relaxation-heat treatment. In general, it has been known that three-dimensional crimps are developed in a conjugate yarn that is produced by spinning a polyester comprising two components with different shrinking properties from one nozzle in parallel with each other or in a core-sheath combination, followed by heat treatment. In a conventional method, therefore, a conjugate yarn is further false-twisted to develop crimps.

The present inventors made studies on the feasibility of a conjugate yarn production method that uses enhanced crimp developing ability to develop crimps in a woven/knitted product, and have shown that preferably, a conjugate yarn produced by spinning and drawing is subjected to heat treatment in a relaxed state so that part of the latent crimps are developed and heat-set.

The number of crimps, CA, in a crimped yarn of the present invention is 2.5–10 crests/cm. This number of crimps, CA, is needed to allow crests or bottoms of crimps in the crimped yarn to exist at interstices in the structure of a woven/knitted products or at portions of loops where restraining forces are weak so that latent crimps can be developed easily when the woven/knitted product is subjected to relaxation-heat treatment again in a subsequent dyeing process. As a result of this, crimps are developed over the surface of the woven/knitted products to impart surface variations in addition to dry touch and stretchability.

The forms of crimps in the self-crimping yarn of the present invention are completely different from those of crimps that are developed in the raw threads produced by spinning and drawing. Specifically, whereas crimps in a conjugate multifilament yarn as spun and drawn are in a spiral, three-dimensional coil form, the crimping form of self-developed crimps of the present invention is close to a two-dimensional wavy form, though three dimensional actually. This wavy form becomes close to two-dimensional when a conjugate yarn of a three-dimensional spiral coil form is subjected to relaxation-heat treatment, which allows polyester polymer components with different heat-shrinking properties to be shrunk and lightly heat-set. Crimps of a three-dimensional spiral coil form are low in stretching stress and developing stress. Compared to this, when relaxation-heat treatment is performed to develop part of the crimps which are then lightly heat-set as proposed herein, crimps are set with latent ability for developing crimps of a three-dimensional spiral coil form at the crests and bottoms of the crimps. Thus the crimps have a large stretching stress, and strain is easily relaxed at portions around crossover points of the woven/knitted product where restraining forces are weak, allowing a relatively loose state to be formed.

Figure 1B:
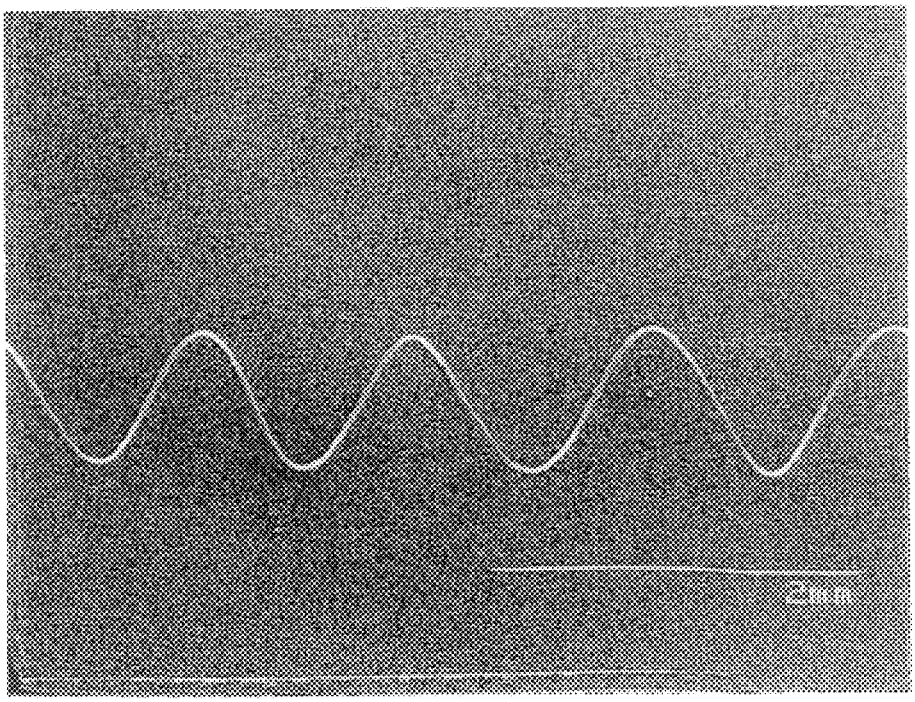
PRIOR ART Fig. 1B
Figure 2A:
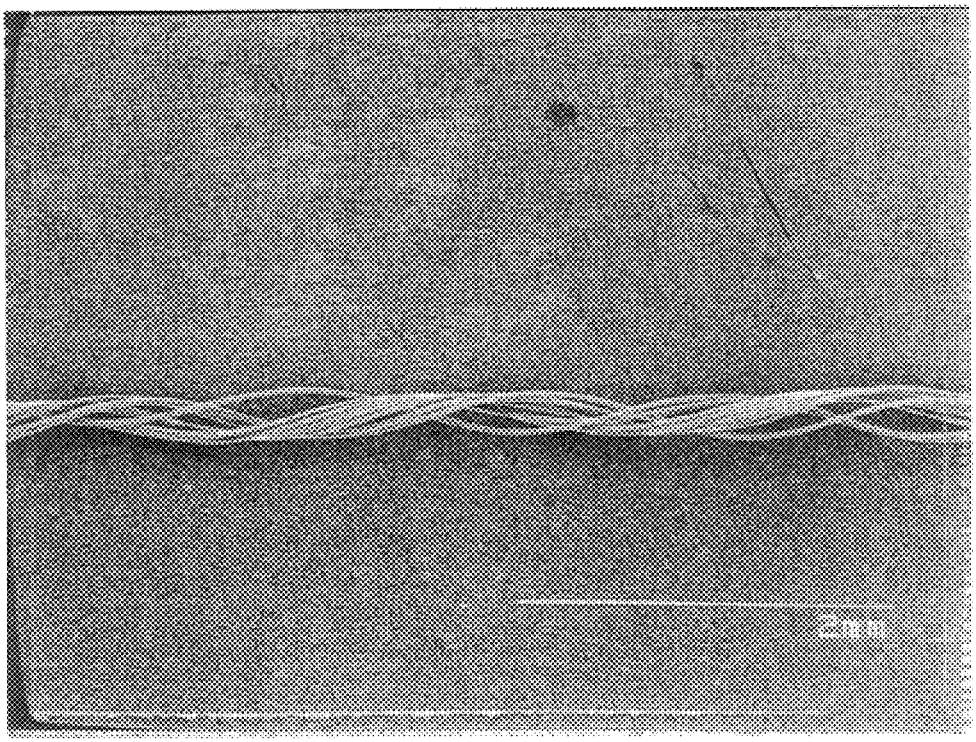
Figure 2B:
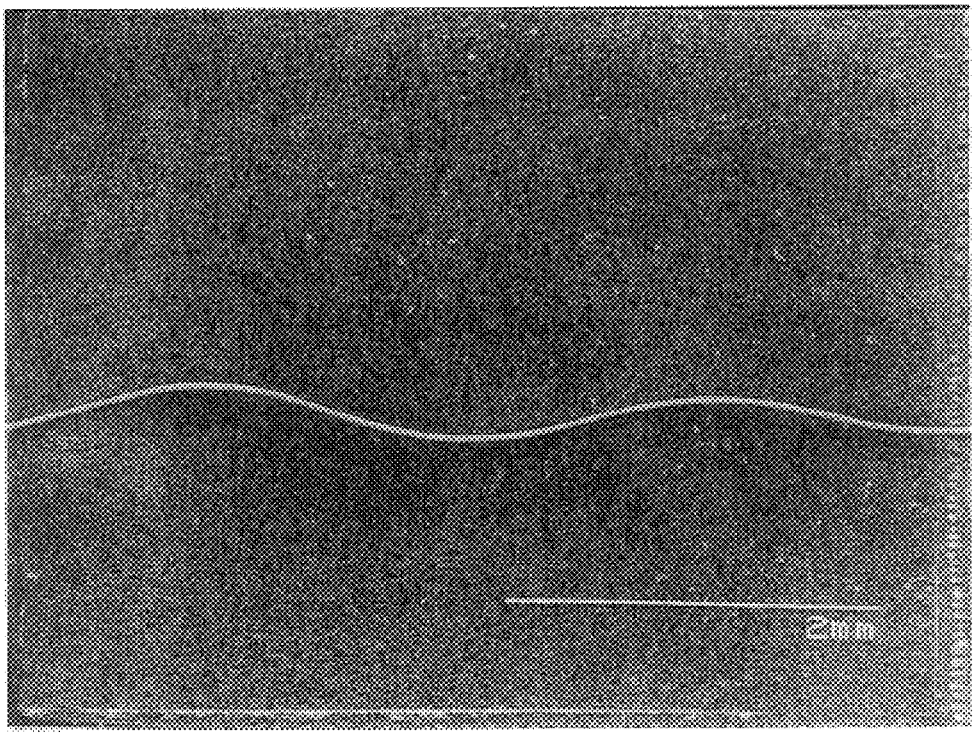

Such forms of crimps as described above are illustrated in FIGS. 1 and 2. FIG. 1 shows an ordinary spun and drawn conjugate yarn of a three-dimensional spiral coil form, with (a) and (b) showing a multifilament yarn and a single filament that constitutes the multifilament yarn, respectively. FIG. 2 shows the structure of the self-crimping yarn of the present invention, (a) and (b) showing a multifilament yarn and a single filament that constitutes the multifilament yarn, respectively. These photographs were taken under a scanning electron microscope supplied by Hitachi, Ltd.

As a major feature of the self-crimped yarn of the present invention, a woven/knitted product produced from a self-crimping yarn having 2.5–10 crests/cm of crimps has an ability of developing 8–30 crests/cm of additional crimps when being subjected to relaxation-heat treatment in the dyeing process. To achieve this, the raw thread used should preferably have a shrinkage stress, TS, in the range of $0.0882 \leqq TS\ (cN/dtex) \leqq 0.221$, a shrinkage percentage in boiling water, SW, in the range of $2\% \leqq SW \leqq 8\%$, and an apparent shrinkage percentage, SC, in the range of $40\% \leqq SC \leqq 80\%$, as described previously. When a woven/knitted product produced from a self-crimping yarn is subjected to a second relaxation-heat treatment in the dyeing process with the aim of developing crimps, such crimps will not be developed if the shrinkage percentage of the self-crimping yarn in boiling water is less than 2%, while if it is more than 8%, developed crimps could be so small that they have difficulty in serving as desired.

The shrinkage stress of the self-crimping yarn is an important factor in the crimps developing after overcoming the restraining force in the structure of the woven/knitted product. The apparent shrinkage percentage is an important characteristic of a raw thread that serves to examine the crimp-forming ability of a self-crimping yarn. Thus the apparent shrinkage percentage can be used to determine whether a crimp-forming conjugate multifilament yarn has a fiber shrinkage stress, i.e., a shrinkage stress that works to develop crimps in the yarn under relaxation-heat treatment. The apparent shrinkage percentage of a self-crimped yarn represents the change in the length of its hank that shrinks as crimps develop under boiling water shrinkage treatment. Crimps may not be able to develop fully or developed crimps may be too small if the apparent shrinkage percentage, SC, is less than 40% or more than 80%.

Thus, one of the important technical points in realizing the raw thread characteristics for the present invention is the relaxation-heat treatment for half-developed crimp formation, which is performed after spinning and drawing a crimp-forming conjugate multifilament yarn during the yarn production process in order to develop crimps while imparting the ability to develop latent crimps under a shrinkage stress.

It has been widely accepted that relaxation-heat treatment of a highly-oriented drawn yarn acts to relax the orientation and reduce the shrinkage stress. The present inventors have carried out earnest studies and revealed that depending on the yarn production conditions and relaxation conditions, a latent crimp developing ability can be imparted to said conjugate yarn by subjecting it to relaxation-heat treatment to develop part of the crimps, followed by heat setting. The relaxation-heat treatment for the present invention is performed preferably with dry heat of 100° C. to 170° C., more preferably 110° C. to 160° C., in order to develop part of the crimps and set them at a relaxation ratio of preferably 2% to 12%, more preferably 4% to 10%, while reducing the shrinkage stress and enhancing the latent crimp developing ability.

If the relaxation ratio is out of the range of 2% to 12%, the number of partially developed crimps could be too small, or the overfeeding could be so large that the shrinking speed will be small as compared to the take-up speed, making it impossible to produce a desired yarn. If the heat treatment temperature is too low, crimps will not be fully developed and heat-set, while if the heat treatment temperature is too high, the crimps developed by the shrinkage of the fiber itself will be too small or the difference in shrinkage between the two components will become zero, resulting, unfavorably, in loose crimps and a decreased shrinkage stress. Useful heat treatment methods include the use of a contact-type heater, a non-contact-type heater (hollow heater), etc. They differ in heating effect, and therefore, the heater-touch time may be adjusted taking into account the heater length, required fiber properties, etc.

For the heat treatment to be performed for the invention, a heat treatment step may be incorporated in the continuous spinning-drawing process. for the yarn production, or a separate relaxation-heat treatment process may be provided in the production process to which a spun and drawn yarn is fed.

In the present invention, said crimped yarn is used to provide a novel-textured woven/knitted product with dry touch and stretchability properties. Said crimp-forming conjugate multifilament yarn used for producing a woven/knitted product should preferably have a fineness of 30–350 dtex, more preferably 50–300 dtex.

When a woven/knitted product comprising a self-crimping yarn of the present invention is applied to the production of clothing, yarns of a small fineness of 30–100 dtex are suitable for thin clothing such as shirts and blouses while yarns of a large fineness of 100–1,000 dtex are suitable for thick woven fabrics such as bottoms (pants, skirt), suits, jackets, and coats. For these uses, the fineness of said crimp-forming conjugate multifilament yarn should be in the range of 30–350 dtex.

A woven fabric comprises a warp and a weft, with a relatively free structure which makes it possible to change relatively easily the length between the intersections where the structural points of the warp and the weft cross each other. For thin woven fabrics, however, a strong twisted yarn has been used conventionally as weft in order to allow an untwisting torque to develop in the dyeing process to impart surface effects caused by wrinkles. Thus, costly means such as additional twisting and false twisting have not been used. In the present invention, a crimp-forming conjugate multifilament yarn is used, and the arrangement and density balance of the warp and the weft are adjusted so that the length of the structural points is varied to produce crests and bottoms of crimps in the crimped yarn and to allow crimps to develop during a relaxation-heat treatment step in the dyeing process etc., which serves to impart three-dimensional crimping effects over the surface of the woven fabric. This will result in a woven fabric with improved surface variations, dry touch, and stretchability. For thick woven fabrics, a multifilament yarn with a large fineness can be used, so such features as surface variations, dry touch, and stretchability can be achieved more easily. In the case of knitted fabrics, any one, whether warp knitted or weft knitted (circular knitted), can serve but only if it comprises loops with a gauge suitable as compared with the thickness of the yarn, the loop length being dependent on the gauge of the knitting machine used. If the loop length is large, the product will be coarse, while if the loop length is small, the product will be dense. The loop length and the crimp size have effect on the surface variations, stretchability, and dry touch properties of the knitted fabric. For instance, if a crimp-forming conjugate multifilament yarn has crimps of 2.5–10 crests/cm, then one crest corresponds to a length of 4–1 mm, and the loop length of a knitting machine used for knitting a fabric of 30–100 dtex will be in the range of 4–1.5 mm. Thus, one loop of the self-crimping yarn can accommodate one crest, and when subjected to relaxation-heat treatment during the re-heat treatment step in the dyeing process etc., latent crimps will be developed easily up to a combined number of crimps of 8–30 crests/cm. The crimps developed have a three-dimensional structure, and a new feature is imparted to the surface of the knitted fabric.

Furthermore, in terms of the crimp developing ability, the single filament that comprises the crimp-forming conjugate multifilament yarn should have a thickness (monof ilament fineness) of 1.1 dtex or more, which serves to provide a woven/knitted product with excellent surface variations and dry touch properties. A monof ilament fineness of 15 dtex or less is particularly preferred for developed crimps to have a desirable three-dimensional form that serves to impart excellent surface variations and feel. For the present invention, the monofilament fineness should preferably be in the range of 2–10 dtex.

In a woven/knitted product produced from a self-crimping yarn of the invention, 35 wt % of the constituent yarns should be accounted for by said conjugate multifilament yarn. If said conjugate multifilament yarn accounts for only less than 35 wt %, the crimp developing ability will be poor, and it will be difficult to impart puffiness (bulkiness), anti-see-through, surface variations (such as surface effects), stretchability, and dry touch properties. Thus, 40 wt % or more is preferred; the effect of the invention can be achieved more desirably as the percentage increases, which may be 100 wt %. In the case of a woven product, the warp and/or the weft may be said conjugate multifilament yarn, or the warp and/or the weft may comprise said conjugate multif ilament yarn arranged in parallel with or combined with another raw thread. There are no specific limitations to the characteristics of said another raw thread, but its shrinkage percentage in boiling water should be low in order to impart a high stretchability.

A woven/knitted product produced from a conjugate multifilament yarn of the invention can be further enhanced in bulkiness, anti-see-through, novel unique surface hand, dry touch properties, and stretchability as intended by the invention if it is further subjected to heat treatment to allow the latent crimps to develop into full ones. The heat shrinkage ratio in this case should be in the range of 10% to 60%.

The present invention further provides a woven/knitted product that, instead of comprising so-called hollow fiber in which the fiber itself incorporates a hollow structure, comprises a hollow structural self-crimping yarn having both stretchability and lightweight properties achieved by the flexibility of spiral aggregates of filaments that incorporate a cavity-like hollow structure. Such a woven/knitted product comprises a twisted conjugate multifilament yarn with the central portion of the spiral multifilament aggregate consisting of a yarn with a cavity structure.

Said hollow structural yarn that constitutes the woven/knitted products of the invention, wherein the central portion of the spiral multifilament aggregate consists of a yarn with a cavity structure, is produced in a process where a crimp-forming conjugate multifilament yarn with a crimp-forming ability is twisted in an aggregate state and then heat treated to allow spiral crimps to form In the length direction of the fiber.

For said crimp-forming conjugate multifilament yarn with a crimp-forming ability, an important factor is the ratio between the two polyester polymer components to be spun together, i.e. the low-viscosity polyester component and the high-viscosity polyester component. The ratio of the low-viscosity polyester component and the high-viscosity polyester component should preferably be 35–65: 65–35 by weight, more preferably 40–60: 60–40 by weight.

The composite form of said crimp-forming conjugate multifilament yarn may be obtained by parallel aligning of the two components or a core-sheath configuration, but the parallel aligning is preferred. The composite ratio and the composite configuration of the two components are related with the diameter of the spiral coils of crimps that are formed during the relaxation-heat treatment of conjugate fiber, with a larger coil diameter giving rise to better lightweight properties. Specifically, the coil diameter should preferably be 200 $\mu$m or more and 1,200 $\mu$m or less, more preferably 300 $\mu$m or more and 1,200 $\mu$m or less.

Normally, the rate of spinning to produce said crimp-forming conjugate multifilament yarn may be from a low range of 1,000 m/min or more to a high range of 2,500 m/min or more. For the next step, any known drawing machine may be used to draw the undrawn or half-drawn yarn produced by the spinning. It is preferred to set such conditions as to achieve a desired stretch level of the drawn yarn as compared to the stretch characteristics of the undrawn or half-drawn yarn and to increase the shrinkage stress during the relaxation-heat treatment of the drawn yarn up to a maximum without producing fluff. The fineness of the single filament that constitutes the crimp-forming conjugate multifilament yarn after drawing should preferably be 1.1–15 dtex as stated previously. In the range smaller than 1 dtex, yarn production is difficult with currently available techniques, and in addition, there are limitations as to the spiral coils, while in the range larger than 15 dtex, a hollow structure may be produced, but with a spiral structure, clothing comprising it will have unfavorably poor hand though the yarn may be softer than ones of a straight structure.

The shrinkage stress of said crimp-forming conjugate multifilament yarn should be as high as possible to enhance the development of latent crimps. The shrinkage stress should be 0.265 cN/dtex or more. For the twisting method for additional twisting of said crimp-forming conjugate multifilament yarn, there are no specific limitations, and any known method may be used. After the twisting, twist-setting treatment may be performed, but the setting temperature should be low to the extent that weaving and knitting can be conducted without trouble.

To produce a hollow structure wherein a cavity structure exists in the central portion of a spiral aggregate of crimp-forming conjugate filaments after being subjected to additional twisting, relaxation-heat treatment may be performed on the yarn, but normally, it should preferably be conducted during the dyeing process for woven/knitted products.

If said conjugate multifilament yarn comprises a hollow multifilament yarn consisting of single filaments, each incorporating a hollow structure, woven/knitted products will have further enhanced lightweight properties and higher resilience.

What requires particular attention in carrying out the invention is the relaxation treatment, and the relaxation conditions should be set so as to allow the relaxation to produce a spiral structure as a result of the untwisting force of the additionally twisted yarn and the development of latent crimps in the conjugate yarn. For this, crimp-forming conjugate multifilament yarn is subjected to additional twisting to form a bundle of filaments. Said spiral crimps resulting from the difference in the shrinkage of the two polyester polymer components with different heat-shrinking properties during relaxation-heat treatment of a woven/knitted product are produced more easily if, for instance, individual filaments are maintained in an aggregate structure with the spiral crimps being kept in phase as shown in FIG. 1. The development of spiral crimps comprising a multifilament aggregate serves to form a cavity in the central portion of the multifilament aggregate.

The number of twists is important in that the apparent diameter of the filament yarn is increased due to the hollow structure, thus increasing the flexural rigidity to impart a high resilience to the woven product. The number of twists is also important to achieve a desired hand, and may be set depending on the desired performance of the woven/knitted product. If the number of twists is too large, the stretchability will decrease unfavorably. To produce a hollow structural yarn comprising a cavity in the central portion of a spiral multifilament aggregate and to impart lightweight properties and a high resilience, the number of twists should be such that the twist coefficient, $\alpha$, which is calculated by the following equation, is in the range of 3,000–30,000, more preferably 7,000–20,000.

$$\text{Number of twists T (T/M)} = \alpha \cdot D^{1/2}$$

where $\alpha$ and D denote the twist coefficient and the fineness of the multifilament yarn, respectively.

A woven product sample was prepared to show the configurational concept of woven/knitted products of the present invention wherein a twisted multifilament yarn comprises a spiral multifilament aggregate with its central portion consisting of hollow structural yarn with a cavity structure, and the cross-section of the woven product after the dyeing process and the side of a yarn (multifilament aggregate) pulling off from the woven product were observed and photographed with a scanning electron microscope as shown in the Figures.

Figure 3:
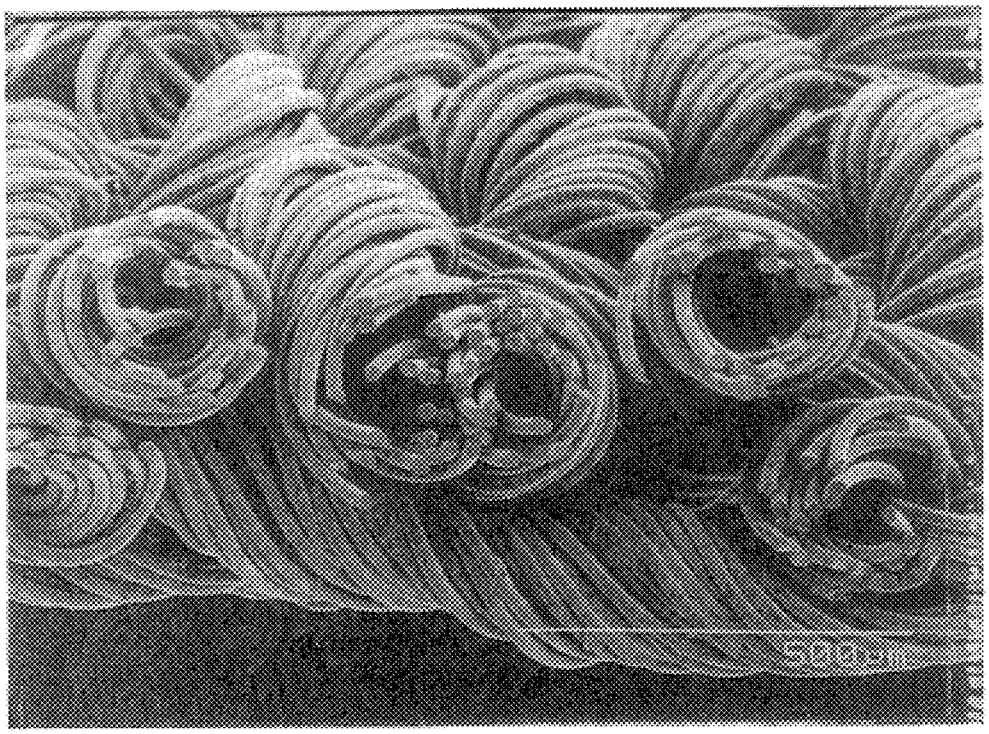
Figure 4:
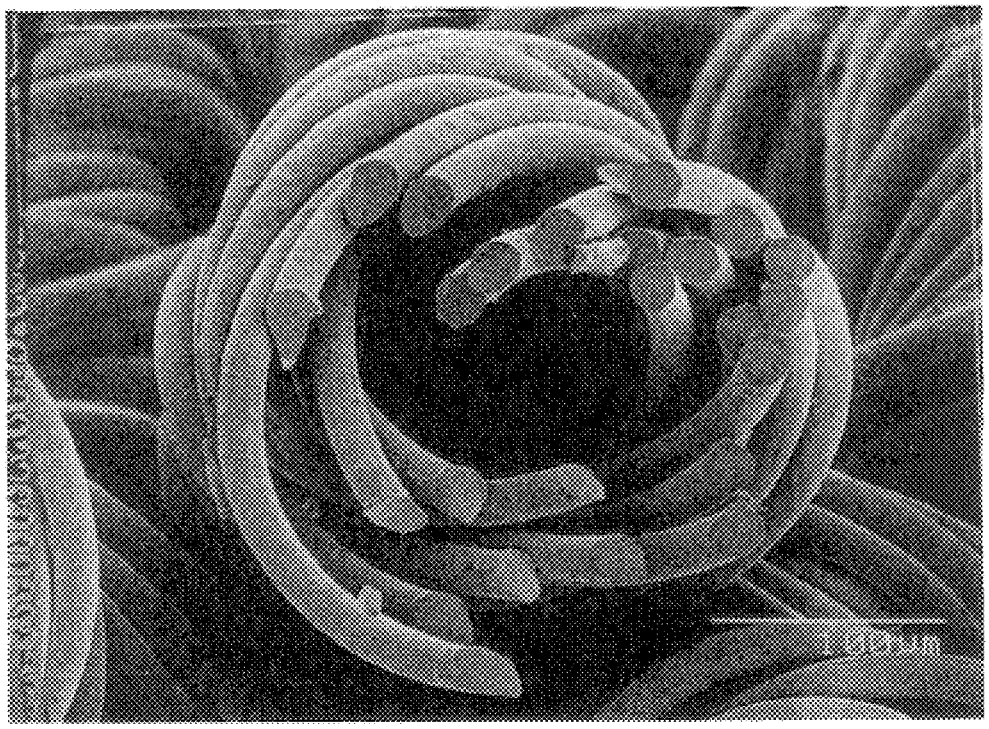
Figure 5:
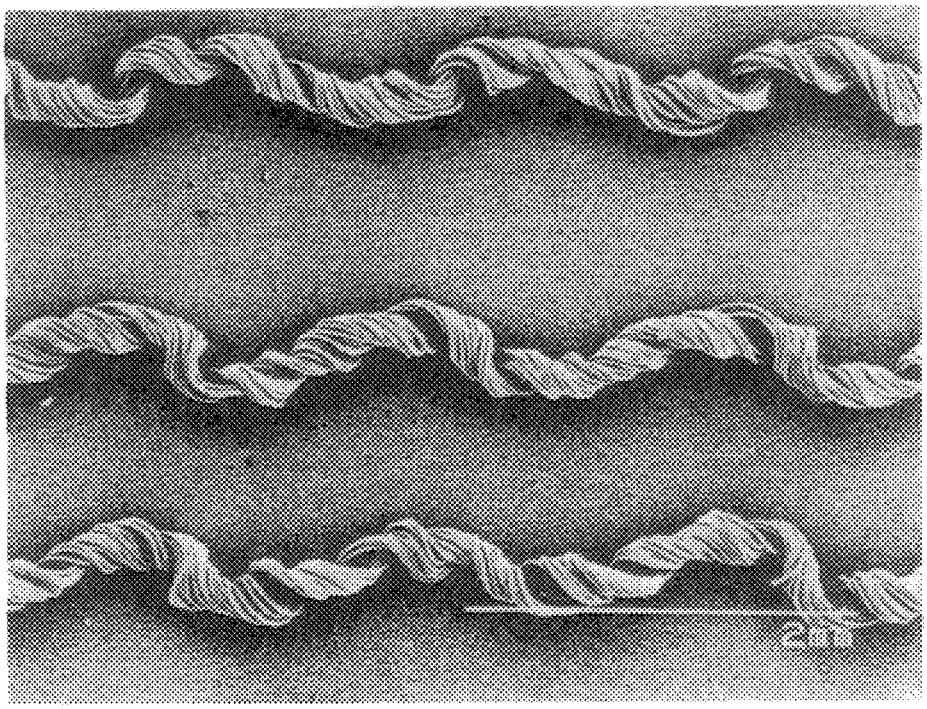
Figure 6:
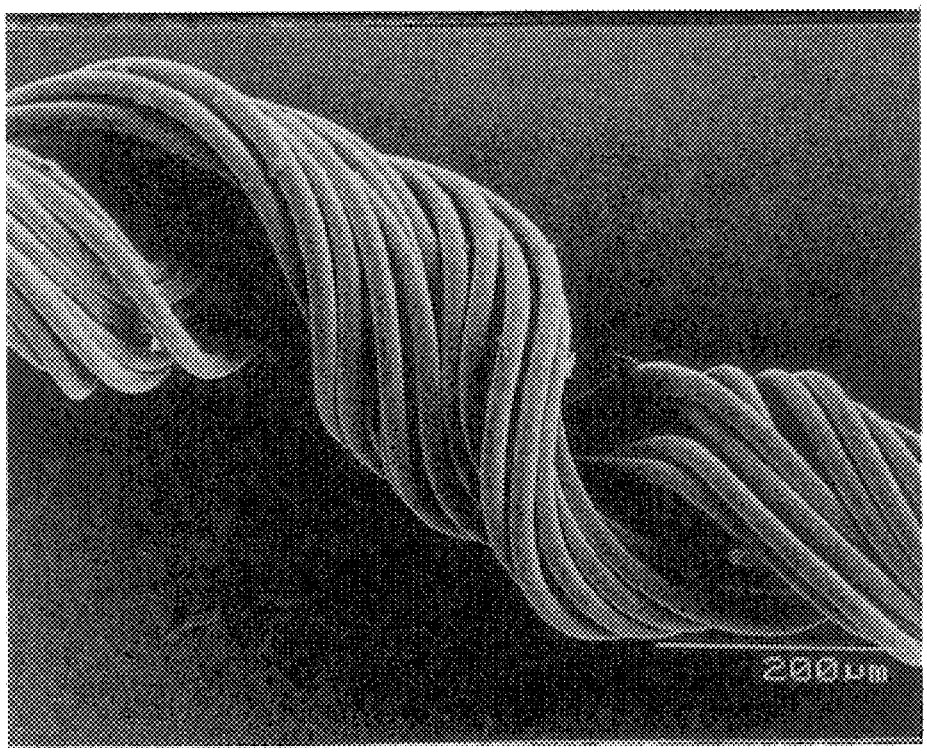

FIG. 3 is a photograph illustrating the cross-section of a weft of a fabric produced in an example for the present invention. FIG. 4 is a magnified photograph of the multifilament aggregate in FIG. 3 which has a hollow structure with a void at the center. FIG. 5 is a lateral photograph of the twisted structure of a multifilament yarn illustrating its hollow state. FIG. 6 is a magnified photograph illustrating a key portion of the photograph of FIG. 3.

The size of the cavity is normally smaller than the diameter of the crimp-forming conjugate multifilament yarn, and should, for instance, be in the range of 20 $\mu$m to 200 $\mu$m. This corresponds to about ⅙ to 1/10 of the coil diameter of the raw thread as the raw tread, i.e. a crimp-forming conjugate multifilament yarn, is twisted.

A crimp-forming conjugate multifilament yarn of the present invention may be combined with another polyester filament yarn to form a composite yarn. Thus, crimp-forming conjugate multifilament yarn A which has a crimp-forming ability and another polyester filament yarn B are doubled and twisted to produce a composite yarn which is then wound on a bobbin. This twisting process is generally used in woven fabric production to impart resilience and draping properties to the woven fabric. In the twisting process, each thread may be twisted separately, or several threads may be twisted together. The resultant composite yarn is then subjected to weaving/knitting and dyeing as described previously. Such a composite yarn can be produced using conventional processes and equipment, and therefore, there are such advantages as eliminating the necessity of additional processes and selecting the other raw thread from a wide variety of candidates. In said composite yarn, the single filaments that constitute crimp-forming conjugate multifilament yarn A should be in the form of an aggregate to enhance the ability of developing spiral crimps. If the single filaments have crimps produced by false twisting, or if the single filaments are dispersed, the crimps developed will be out of phase and will have difficulty in forming coil-like (spiral) crimps. In this connection, the crimp-forming conjugate multifilament yarn A may be a yarn simply air-intermingled and bundled.

A drawn yarn is normally used as polyester filament yarn B. There are no specific limitations as to the type of the drawn yarn, and any appropriate one may be selected from among those widely used. However, those with a smaller boiling water shrinkage percentage are more preferred. If the boiling water shrinkage percentage is high, polyester filament yarn B can form an inner layer inside of the crimp-forming conjugate multifilament yarn A, which prevents the polyester filament yarn B from serving effectively in the composite yarn. In the case of a highly shrunk yarn whose shrinkage percentage is too high, the highly shrunk yarn will thrust into the innermost layer during the shrinkage process, making it difficult to impart stretchability to the woven fabric. Thus, the shrinkage percentage of polyester filament yarn B should be low in order to prevent stretchability from being developed as crimps are formed. It should normally be set to 10% or less, preferably +8% to −10%. Said polyester filament yarn B may be subjected first to relaxation-heat treatment to reduce the shrinkage percentage, or a highly oriented undrawn yarn may be heat-treated to decrease the shrinkage percentage.

Said polyester filament yarn B, furthermore, should have characteristics that are directly related to the objectives and intended effects of the intended composite yarn. For instance, an extra fine yarn may be used to impart a soft hand, or fine ceramic particles, which form microvoids that act to reduce the regular reflection of light from the fiber surface, may be added at the alkali volume reduction step in the dyeing process in order to enhance the coloring properties. Furthermore, a modified cross-section yarn or a fine-particle-containing yarn may be used.

Resultant effects will differ with the type of the raw thread used; the effects of the raw thread will be achieved effectively when combined with crimp-forming conjugate multifilament yarn A as puffiness is imparted as a result of crimps being developed in the dyeing process. Considering this, it is preferred to use two raw threads that are different in their ratios of alkali volume reduction in the dyeing process.

For instance, if a composite yarn that consists of crimp-forming conjugate multifilament yarn A which has an ability to develop crimps and polyester filament yarn B whose fiber surface comprises an alkali-soluble component is subjected to alkali volume reduction treatment after crimps have been developed in a woven fabric, a cavity will be formed between the conjugate yarn which is located in a relatively inner layer and the alkali-soluble component which is located at a relatively outer layer, and enhances the crimp developing ability after the relaxation-heat treatment process, leading to further increased puffiness and stretchability.

The combining step for producing said composite yarn can be performed in a conventional twisting process that is widely adopted as preliminary processing for weaving. To twist said two lines of thread into a yarn, they may be wound on a pirn winder, followed by being subjected to a double twister to achieve twisting, or they may be continuously twisted in a doubling and twisting frame.

The number of additional twists should be at least such that the raw threads are firmly bundled in the composite yarn, but should preferably be such that the twisting coefficient is 3,000 or more to allow spiral crimps to be formed. Its maximum depends on the overall fineness of the crimped composite yarn, but should preferably be such that the twist coefficient $\alpha$ as calculated by the following equation is about 20,000 or less, more preferably 18,000 or less:

$$a=T\times D^{1/2}$$

where $\alpha$, T, and D denote the twist coefficient, number of twists (t/m), and fineness of the composite yarn, respectively.

If the twist coefficient is more than 20,000, the fiber restraining force will be too strong, the number of crimps developed in the conjugate yarn too small, the puffiness insufficient, and the stretchability not high enough.

As kinky portions sometimes tend to be formed due to the twisting torque, twist setting may be performed to reduce the twisting torque to the extent that the passage through the weaving process is not hindered significantly. Said setting should be conducted at a low temperature as long as it does not cause trouble.

Important characteristics of said composite yarn include the composition ratios of crimp-forming conjugate multifilament yarn A and polyester filament yarn B, their fineness, and the properties of the yarn to be coupled with.

In a composite yarn comprising a conjugate multifilament yarn A and a polyester filament yarn B, the fineness of said conjugate multifilament yarn should preferably be in the range of 30–150 dtex.

The composition ratio of conjugate multifilament yarn in said composite yarn, A/(A+B)×100, should be 30% or more and 60% or less by weight, preferably 35% or more and 55% or less by weight. The desirable ratio depends on the other raw thread, i.e. polyester filament yarn B. For instance, a ratio of about 30% is sufficient for a yarn with a small flexural rigidity such as an extra fine filament yarn, but the composition ratio of conjugate multifilament yarn A has to be increased if the number of additional twists is large or if a high-density woven fabric is required. On the contrary, if a raw thread with high coloring performance is to be mated in order to enhance the coloring performance for black, the ratio of the conjugate multifilament yarn A should be as low as possible, with a ratio of 40% being a typical value.

Figure 7:
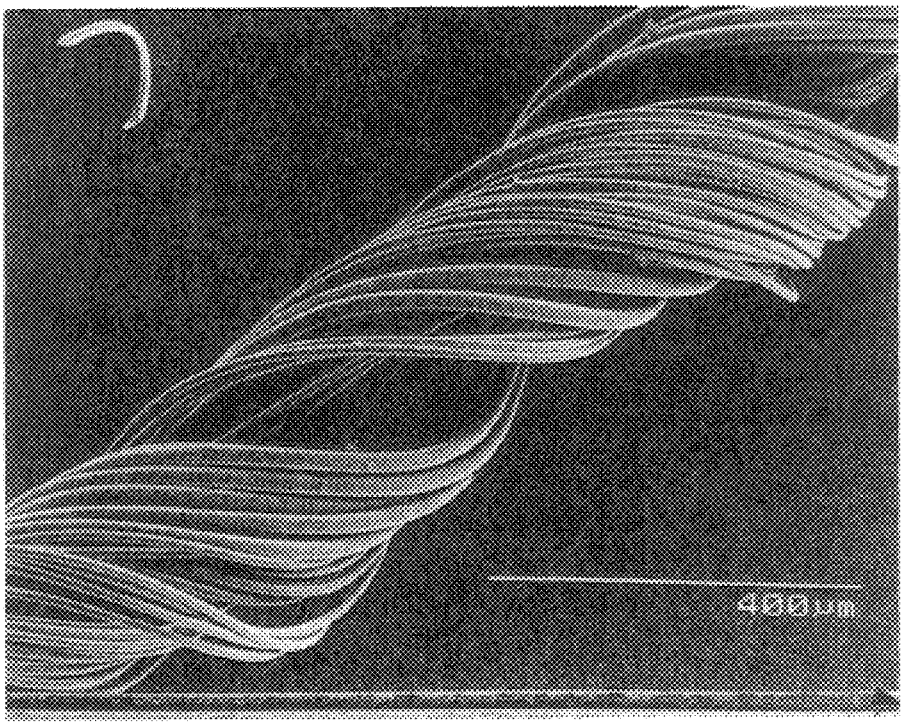
Figure 8:
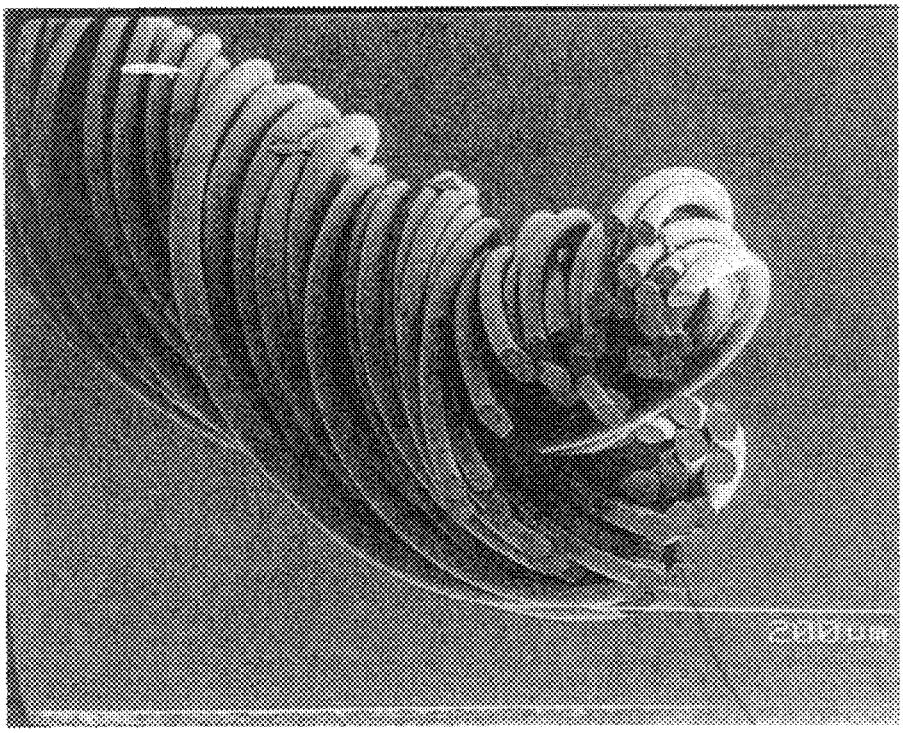

A composite yarn of the present invention should preferably have a hollow structure with a cavity incorporated in the yarn. Thus, lightweight properties and high resilience can be imparted by allowing spiral crimps to form a hollow structure with cavities. An effective way is to minimize the boiling water shrinkage percentage of the raw thread to be mated and to decrease the number of additional twists. FIGS. 7 and 8 show examples of said hollow structure resulting from the development of spiral crimps in a composite yarn as described above.

FIG. 7 is a photograph illustrating the lateral side of the composite yarn produced in Example 12, which is described below to illustrate the invention.

FIG. 8 is a photograph illustrating the cross-section of the composite yarn produced in Example 12, which is described below to illustrate the invention. In FIG. 8, however, the composite yarn is not cut sharply, and the cavity portion cannot be observed very clearly.

Said polyester filament B, which is to be mated with yarn A in the invention, should preferably be a false-twisted crimped yarn, but may be a drawn one, POY-DTY, or a structurally finished thread produced by combining two types of raw thread.

The direction of twisting of said crimped composite yarn depends on the number of twists, type of the yarn to be combined, and the direction of the additional twists, but it should preferably be opposite to the twisting direction of the false-twisted polyester multifilament yarn which is to be combined. This is because if the direction of the additional twists is opposite to the direction of the torque of the false-twisted yarn, it acts to open the single filaments in the false-twisted yarn, or to allow it to bulge, making it easier for crimps to be developed in crimp-forming conjugate multifilament yarn A. In some cases where kinky portions are formed due to a twist torque, twist setting may be carried out to decrease the twist torque to the extent that it will not cause trouble in the passage through the weaving process. Said setting should be performed at a minimum possible temperature as long as it does not cause trouble.

Other important characteristics of said crimped composite yarn include the composition ratios of the crimp-forming conjugate multifilament yarn A and polyester filament yarn B, their fineness, and the properties of the yarn to be combined.

In said composite yarn comprising crimp-forming conjugate multifilament yarn A and another polyester filament yarn B, said crimp-forming conjugate multifilament yarn A is 30–200 dtex in fineness, and the composition ratio of said crimp-forming conjugate multifilament yarn A, A/(A+B)×100, in said composite yarn is 20% or more and 80% or less by weight, preferably 30% or more and 60% or less by weight, as described previously. The desired ratio depends on the characteristics of the raw thread to be combined. A ratio of 20% may be sufficient if the other raw thread is one with a low monofilament fineness, such as a bulky false-twisted crimped yarn produced from an extra fine filament thread, but normally, 30% is a typical value. If in the present invention, a false-twisted yarn such as wooly thread or composite false-twisted yarn which is used as the other raw thread to be combined is twisted in the opposite direction to the torque of said false-twisted yarn used, that is, subjected to additional twisting in the opposite direction, it works to allow the single filaments in said false-twisted yarn to bulge, and under such conditions, the binding force of said conjugate yarn will decrease, making it easier for cavities to be formed as spiral crimps develop. A hollow structure with cavities will also be formed in the case where twisting is carried out in the same direction as that of the torque of the false-twisted yarn used.

Figure 9:
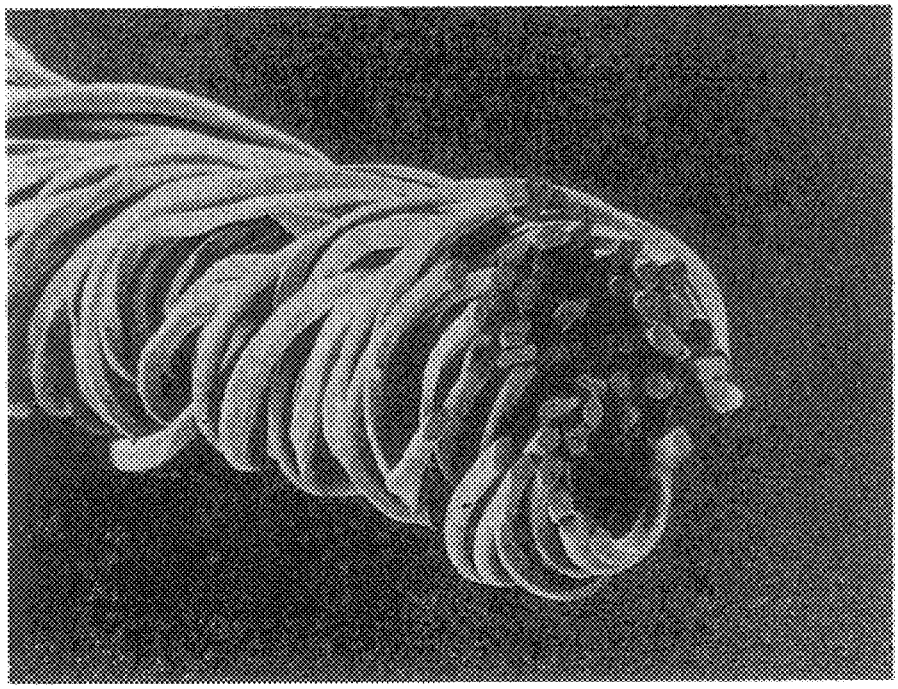
Figure 10:
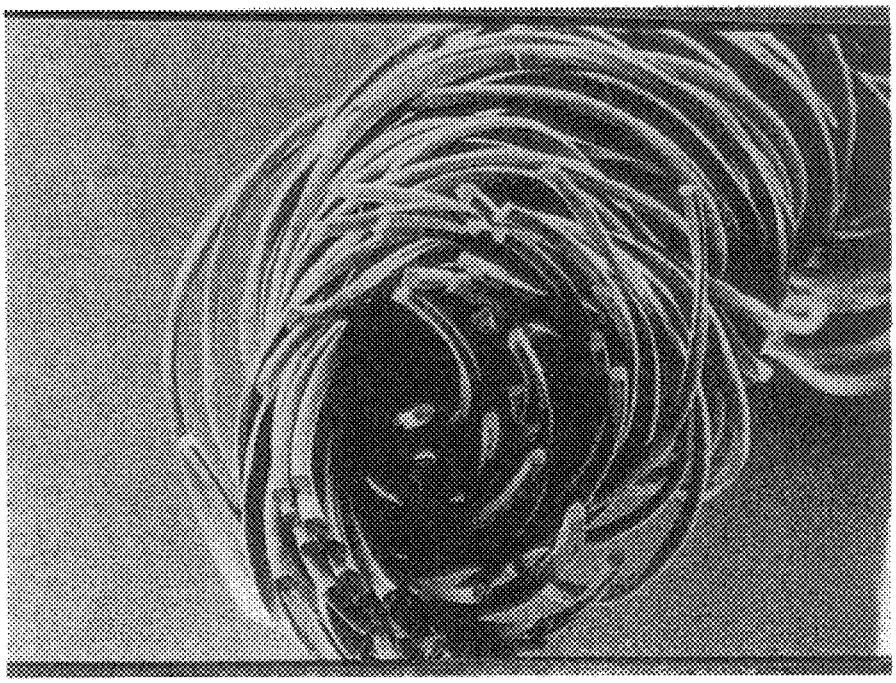

FIGS. 9 and 10 are examples of said hollow structure that results from the development of spiral crimps in said composite yarn comprising crimp-forming conjugate multifilament yarn A and another polyester filament yarn B as described above.

FIG. 9 is a photograph illustrating the fiber in the crimped composite yarn of the invention produced in Example 15, which is twisted in the opposite direction to the direction of torque of the false-twisted thread used.

FIG. 10 is a photograph illustrating the fiber in the crimped composite yarn of the invention produced in Example 15, which is twisted in the same direction as the direction of torque of the false-twisted thread used.

Woven/knitted products comprising a composite yarn of the present invention are described below.

A composite yarn of the present invention can serve effectively as warp and/or weft of a woven fabric. The weaving process may comprise conventional warp preparation, though sizing should be carried out if the number of twists is small. Otherwise, standard process conditions will serve favorably. There are no specific limitations on the type of weaving machine.

The desirable structure and density of a woven fabric depends on the desired hand, and there no specific limitations. However, the number of twists should preferably be lower than typical ones in order to maximize the crimp developing effect in the dyeing process. Depending on the structure of the woven fabric, the density of the gray fabric should preferably be sufficiently high to the extent that weave distortion will not take place as the dyed woven fabric is worn after being sewn.

A gray fabric, after being woven, may be processed in dyeing processes and conditions that are normally used for "new synthetic fibers." For instance, standard dyeing processes and conditions include refining, relaxation (for instance, 60–100° C. for extended state like sofcer M/C), presetting (dry heat 170–200° C.), alkali volume reduction (N reduction ratio 0–35%), dyeing (jet dyeing machine 130–135° C.), shrink surfer (over-feed relaxation), and finish-setting (150–180° C.).

As for processing conditions, what is the most important is to allow the crimps of the composite yarn to be developed to the full. Alkali volume reduction should preferably be performed to impart moderate resilience to the woven fabric. Its conditions depend on the composition of the composite yarn, weave of the woven fabric, and density, and are determined based on tests made at varying reduction ratios after relaxation and presetting. For dyeing, a jet dyeing machine may be used to enhance the crumple effect and increase the bulkiness of the composite yarn.

To impart puffiness and stretchability to a woven fabric by using said composite yarn, the conjugate multifilament yarn used should have a latent ability of developing crimps, when treated in boiling water, up to a CA (number of crimps) of 8–30 crests/cm, preferably 13–27 crests/cm.

This crimp forming ability is what enables crimps to be developed under the restraining force of the structure of the woven fabric. For these crimps to be developed under the restraining force, said crimp-forming conjugate multifilament yarn with the ability of developing crimps should have a shrinkage stress, TS, of 0.265 cN/dtex or more, preferably 0.291 cN/dtex or more (N denotes Newton). If said conjugate multifilament yarn is low in the number of crimps developed and shrinkage stress, the composite yarn, after being twisted and processed into a woven fabric, will have difficulty in shrinking to develop spiral crimps when subjected to relaxation-heat treatment in the dyeing process, making it difficult to impart required puffiness and stretchability to the woven fabric.

EXAMPLES

EXAMPLES 1–4, COMPARATIVE EXAMPLE 1

The five drawn yarn samples with different fiber properties shown in Table 5 were prepared by the following procedure: an undrawn conjugate multifilament yarn (12 filaments) that consisted of a low-viscosity component comprising a polyethylene terephthalate with an intrinsic viscosity of 0.40 and a high-viscosity component comprising a polyethylene terephthalate with an intrinsic viscosity of 0.75 stuck to each other in parallel with a composition of 50:50 by weight is spun and drawn up to a draw ratio which differed among the five samples. These drawn yarn samples were used to produce self-crimping yarn samples under different relaxation-heat treatment conditions. The resulting self-crimping yarn samples were used to produce knitted products using a 32-gauge cylindrical knitting machine, which were dyed at 100° C. for 30 min and compared in terms of surface variations (wrinkle formation), feeling, and stretchability (power). Results are shown in Table 1 below.

TABLE 1

| | Example 1 | Example 2 | Example 3 | Example 4 | Comparative example 1 |
|---|---|---|---|---|---|
| Before relax-heat treatment | | | | | |
| Fineness (dtex) | 52.9 | 52.1 | 50.9 | 55.3 | |
| Strength (cN/dtex) | 3.28 | 3.29 | 3.56 | 3.12 | |
| Elongation (%) | 22.6 | 16.2 | 18.0 | 44.4 | |
| Apparent shrinkage (%) | 60.7 | 61.7 | 63.6 | 54.3 | |
| Fiber shrinkage | 4.6 | 4.8 | 5.2 | 12.7 | |

TABLE 1-continued

| | Example 1 | Example 2 | Example 3 | Example 4 | Comparative example 1 |
|---|---|---|---|---|---|
| (%) | | | | | |
| Shrinkage stress (cN/dtex) | 0.327 | | 0.441 | 0.424 | 0.229 |
| (° C.) | 162 | | 158 | 159 | 108 |
| No. of crimps (crests/cm) | 2.9 | | 2.8 | 3.7 | 0.6 |
| No. of crimps developed | 27.3 | | 21.1 | 20.1 | 13.7 |
| Conditions | | | | | |
| Heater temp. | 155 | 172 | 155 | 115 | 150 |
| Relaxation ratio (%) | 7.5 | ← | 10 | 7 | 2 |
| Heat-setting time (sec) | 0.032 | ← | 0.047 | 0.20 | 0.065 |
| After relax-heat treatment | | | | | |
| Fineness (dtex) | 53.9 | 55.0 | 53.7 | 55.0 | 57.2 |
| Strength (cN/dtex) | 3.00 | 3.13 | 3.11 | 3.34 | 3.15 |
| Elongation (%) | 19.3 | 28.8 | 15.6 | 20.0 | 46.0 |
| Apparent shrinkage (%) | 63.6 | 53.8 | 67.4 | 68.0 | 38.0 |
| Fiber shrinkage (%) | 2.5 | 0.7 | 3.0 | 3.4 | 2.5 |
| Shrinkage stress (cN/dtex) | 0.150 | 0.079 | 0.212 | 0.194 | 0.062 |
| (° C.) | 188 | 205 | 175 | 188 | 165 |
| No. of crimps (crests/cm) | 4.2 | 2.3 | 6.2 | 5.4 | 0.5 |
| No. of crimps developed | 13.9 | 17.5 | 13.1 | 13.7 | 7.0 |
| Quality | | | | | |
| Surface variations (crimping) | ○ | Δ | ◎ | ◎ | × |
| Hand (dry touch) | ○ | Δ | ◎ | ◎ | × |
| Stretchability (power) | ○ | Δ | ◎ | ◎ | × |

In Examples 1, 3, and 4, the important characteristics for the relaxation-heat treated self-crimping yarn, i.e., the number of crimps and the number of developed crimps, were fully achieved, and their effects were confirmed in the knitted products. In Example 2, the number of crimps in the self-crimping yarn was slightly smaller than required, and the fiber shrinkage percentage and shrinkage stress were also small, resulting in a product with poor characteristics as compared to Example 1.

In Comparative example 1, the relaxation conditions for spun and drawn conjugate multifilament yarn were examined. The raw thread itself was high in shrinkage percentage, but low in shrinkage stress, and a required relaxation ratio was not achieved in the relaxation-heat treatment, making it impossible to produce a self-crimping yarn with a sufficient number of crimps and number of developed crimps.

EXAMPLE 5, COMPARATIVE EXAMPLE 2

A regular polyester 55 dtex-36F triangle cross-section yarn was sized and used as warp while the raw threads prepared in Example 4 and Comparative example 1 were used as weft for the crepe de chine standards to weave a gray fabric. The gray fabric obtained was then subjected to a conventional dyeing process for crepe de chine fabric production. Observations of the resultant fabric showed that fine crimps had been developed on the surface of the woven fabric comprising the raw thread prepared in Example 4, with elegant uneven variations, dry touch properties, and stretchability found to have been imparted to the fabric. Compared to this, the woven fabric comprising the raw thread prepared in Comparative example 1 had a smooth flat surface with smooth touch, and had only a slight stretchability.

EXAMPLE 6

A 55 dtex-12F drawn yarn was prepared by spinning and drawing an undrawn conjugate multifilament yarn that consisted of a low-viscosity component comprising 100% polyethylene terephthalate with an intrinsic viscosity of 0.40 and a high-viscosity component comprising polyethylene terephthalate with an intrinsic viscosity of 0.75 stuck to each other side by side with a composition of 50:50 by weight. For the resulting drawn yarn, a yarn processing machine equipped with a hollow dowtherm-type heater with a heater length of 1 m, which is generally used for producing combined filament yarn, was used to perform relaxation-heat treatment to produce a crimped yarn. The relaxation-heat treatment was carried out under such conditions as a heater temperature of 120° C. and a relaxation ratio of 7%. The characteristics of the resulting crimped yarn included a fineness of 55.0 dtex, number of crimps (CA) of 5.4 crests/cm, number of latent crimps developed (CB) of 13.7 crest/cm, shrinkage stress of 0.194 cN/dtex (peak temperature 188° C.), boiling water shrinkage percentage of 3.4%, and an apparent shrinkage percentage of 68.0%.

Two lines of said crimped yarn were twisted together up to 1,000 t/m (Z twisting). Elsewhere, a half-drawn 88 dtex-24 filament yarn with an elongation of 160% prepared by spinning a polyester regular polymer was heat-set at 60° C. in a dry-heat heater was air-intermingled, using an interlacing nozzle, with a 110 dtex-18 filament polyester regular yarn with a boiling water shrinkage percentage of 12% to produce a 170 dtex-42 filament polyester combined filament yarn with a different shrinkage percentage, which was subjected to additional twisting up to 800 t/m (S twisting). These twothreads were used as warp and weft, one next to the other, in a water jet loom to produce a mat-weave woven fabric. The combined filament yarn with a different shrinkage percentage had a boiling water shrinkage percentage of 8%.

The density of the gray fabric produced was warp 117 lines/2.54 cm and weft 79 lines/2.54 cm. The composition ratio of the crimped yarn and the polyester combined filament yarn with a different shrinkage percentage in the gray fabric was 39:61 by weight. The gray fabric was subjected to a standard dyeing process for "new synthetic fiber" production which consisted of such steps as refining, relaxation, preliminary setting, alkali volume reduction, dyeing, and finish-setting carried out under standard processing conditions. The density of the processed fabric was warp 182 lines/2.54 cm and weft 100 lines/2.54 cm. The shrinkage caused by processing relative to the gray fabric was 55% in the width direction and 26% in the length direction. The woven fabric obtained had surface variations comprising lozenge-shape wrinkles caused by crimp development, as well as excellent stretch and stretch-back properties and delicate dry touch properties.

For comparison, a yarn produced by twisting a conventional commercial 110 dtex-36F wooly thread up to a 1,000 t/m and a raw thread for intermingling produced by twisting a 165 dtex-48F regular polyester multifilament thread with a boiling water shrinkage percentage of 8% up to 800 t/m were used as warp and weft, one next to the other, to produce a woven fabric under the same conditions as in Example 6, followed by dyeing. Observations of the resulting fabric showed that it had no surface variations nor stretchability, and it lacked high-class appearance.

EXAMPLE 7, COMPARATIVE EXAMPLE 3

The same raw thread as prepared in Example 6 was subjected to a JIL-7 32-gauge 30-inch double circular knittingmachine (Fukuhara Seiki Co., Ltd.) to knit an interlock fabric. The knitting conditions included a width of 180 cm, length of 64 m, weight of 8.9 kg (METSUKE 140 g/m), wale×horizontal row of 42.3×55, and loop length of 197 mm/100 W. Subsequently, the resulting gray fabric was subjected to a dyeing process comprising refining, relaxation, preliminary setting, alkali volume reduction, dyeing. and finish-setting, which were carried out under typical conditions.

The resulting finished fabric had a width of 115 cm, length of 46.6 m, weight of 7.4 kg (METSUKE 160 g/m), and wale×horizontal row of 64.6×76.8. The resulting circular knitted fabric had shrunk by 53% in the wale direction and 40% in the horizontal row direction to develop three-dimensional crimps which impart bulkiness and anti-see-through to the fabric. Its surface had an appearance that was characteristic of three-dimensional crimps and unachievable with conventional raw threads, and had pleasant feeling and dry touch properties. As shown in Table 2, the stretchability of said fabric is higher than that of general knitted fabrics produced from a conventional false-twisted yarn, providing a highly new fabric. This should be because the number of crimps developed in the crimped yarn 5.4 crests/cm is equivalent to 1.8 mm/crest while the loop length is 1.97 mm, indicating that one crest exists in each loop, making it easy for latent three-dimensional crests to be developed in the dyeing process up to 13.7 crests/cm. For comparison, a conventional commercial 55 dtex-24F false-twisted yarn (2-heater false twisting) was used to knit a fabric under the same conditions as in Example 7, which was then dyed under the same conditions as in Example 7. The resulting knitted fabric had an appearance of a conventional thread, and though good in bulkiness and anti-see-through, unlike multifilament fabrics, said fabric lacked high-class appearance or high stretchability. Results of its evaluation are shown in Table 2.

TABLE 2

| Circular knitting machine<br>Structure<br>Yarn type | | | Example 7<br>32 gauge<br>interlock<br>55 dtex-12f | Example 8<br>32 gauge<br>interlock<br>55 dtex-12f |
|---|---|---|---|---|
| Elongation (%) | Longitudinal | weight 500 g | 19.3 | 19.7 |
| | | weight 1000 g | 33.3 | 29.5 |
| | | weight 1500 g | 44.1 | 36.3 |
| | Transverse | weight 500 g | 37.3 | 31.4 |
| | | weight 1000 g | 63.8 | 57.6 |
| | | weight 1500 g | 88.4 | 77.6 |

Measuring Conditions

JIS (1018) "Test methods for knitted fabrics"

Distance between grips: 7.6 cm

Speed of extension: 10 cm/min

Chart speed: 20 cm/min

Initial weight: 3 g

Fixed loading: 1.5 kg elongation

EXAMPLE 8

The 55 dtex-12F crimped yarn produced in Example 6 was used to prepare a warp knitted fabric. In a 28-gauge single tricot machine, said crimped yarn was used for both reeds to produce an atlas-pattern knitted fabric. Knitting was performed under the conditions of a width of 128.6 cm, length of 433 racks, weight of 8.4 kg, and wale×horizontal row of 28.0×90.0. The gray fabric was subjected to a dyeing process which consisted of such steps as gray fabric setting, refining, relaxation, preliminary setting, alkali volume reduction, dyeing, and finish-setting carried out under standard processing conditions. The resulting finished fabric had a width of 115 cm, length of 46.6 m, weight of 7.4 kg (METSUKE 160 g/m), and wale×horizontal row of 64.6×76.8. The resulting warp knitted fabric had shrunk by 24% in the wale direction and 43% in the horizontal row direction to develop three-dimensional crimps which impart bulkiness and anti-see-through to the fabric. Its surface had an appearance that was characteristic of three-dimensional crimps and unachievable with conventional raw threads, and had pleasant hand and dry touch properties. The stretchability of said fabric is higher than that of general woven fabrics produced from a conventional false-twisted yarn, providing highly new fabric.

EXAMPLE 9, COMPARATIVE EXAMPLE 4

A 110 dtex-24 filament conjugate multifilament yarn was prepared by spinning and drawing an undrawn conjugate multifilament yarn that consisted of a low-viscosity component comprising 100% polyethylene terephthalate with an intrinsic viscosity of 0.40 and a high-viscosity component comprising polyethylene terephthalate with an intrinsic viscosity of 0.75 stuck to each other in parallel with a composition of 50:50 by weight.

The fiber properties of the resulting multifilament yarn were determined according to JIS L1023 "Testing methods for chemical fiber filament yarn" and JIS L1096 "Testing methods for bulky synthetic fiber filament thread". Results showed that said yarn had a fineness of 110.6 dtex, a strength of 3.26 cN/dtex, boiling water shrinkage percentage of 4.0%, and a shrinkage stress of 0.357 cN/dtex. This multifilament yarn was subjected to additional twisting of 1500 twists/m (corresponding to a twist coefficient $\alpha$ of 15,000) and twist-setting at 65° C. for 40 min using a vacuum steam setting apparatus. Subsequently, said multifilament yarn was used as both warp and weft to produce a twill-derivative fabric. Its density was 94×76 lines/inch. The resulting gray fabric was dyed by performing relaxation-heat treatment at 110° C. with a jet dyeing machine, intermediate heat-setting in dry heat at 190° C. using a pin tenter, alkaline volume reduction by 20%, and dyeing at 130° C. The density of the finished fabric was 123×92 lines/inch.

For comparison, a conventional commercial 110 dtex-48 filament draw false-twisted yarn was processed under the same conditions, including the number of additional twists, weaving conditions and dyeing conditions, as in Example 9 to produce a woven fabric with similar characteristics to those in said example. Whereas the woven fabric obtained in Example 9 had a very high resilience, good lightweight properties, high stretchability, and dry touch properties, the woven fabric obtained in Comparative example 4 had rigid feel that appeared to reflect excessive additional twists, and was much poorer in weight, resilience and lightweight properties as compared to the fabric produced in Example 9.

EXAMPLE 10, COMPARATIVE EXAMPLE 5

The yarn subjected to additional twisting in Example 9 was subjected to a 28-gauge circular knitting machine to knit an interlock fabric. For comparison, a low-torque 82.5 dtex-24 filament yarn produced from low-temperature drawn false-twisted regular POY thread was subjected to additional twisting of 1,200 twists/m, twist-setting, and knitting with a 28-gauge circular knitting machine under the same conditions as in Example 10 to produce an interlock fabric. The resulting gray fabric was dyed and finished by the same procedure as in Example 10 and Comparative example 4. Compared to Comparative example 5, the knitted fabric produced in Example 10 had such features as high resilience, high stretchability, and good lightweight properties.

EXAMPLE 11–18, COMPARATIVE EXAMPLE 6–9

A 50 dtex-12F crimped drawn yarn was prepared by spinning and drawing an undrawn conjugate multifilament yarn that consisted of a low-viscosity component comprising 100% polyethylene terephthalate with an intrinsic viscosity of 0.40 and a high-viscosity component comprising polyethylene terephthalate with an intrinsic viscosity of 0.75 stuck to each other side by side with a composition of 50:50 by weight. The characteristics of the resulting crimped conjugate multifilament yarn included a fineness of 51.6 dtex, number of developed crimps of 15.2 crests/cm, shrinkage stress of 0.441 cN/dtex (peak temperature 155° C.), fiber shrinkage percentage of 4.6%, and an apparent shrinkage percentage of 65.2%.

The resulting crimped conjugate multifilament yarn was used with a conventional drawn polyester multifilament yarn, a non-torque composite yarn produced by heat-treating a polyester multifilament thread and a highly oriented undrawn thread, or a Z-twisted wooly yarn to produce composite yarns, which were then used to produce woven fabric samples.

For comparison, 165 dtex-48 filament wooly yarn was used alone to produce a woven fabric (wiping cloth) by the same procedure as above. All woven fabric samples had a 2/2 twill pattern. The density of the gray fabric was determined by incorporating the denier-converted cover factor. Dyeing was carried out under standard conditions for relaxation, preliminary setting, alkalivolume reduction, dyeing, and finish-setting. Results are shown in Tables 3 and 4.

TABLE 3

| | | Example 11 | Example 12 | Example 13 | Example 14 | Comparative example 6 | Comparative example 7 |
|---|---|---|---|---|---|---|---|
| Conjugate multifilament yarn | | 50dtex-12fil | | 100dtex-24fil | | none | |
| Raw thread to be combined | | 165dtex-48fil (regular semi-dull drawn yarn) | | 170dtex-48fil (regular/highly oriented undrawn yarn, heat-treated) | | 165dtex-48fil (Z-twisted wooly-processed) | |
| Crimped composite yarn production conditions | Twisting method | multiple wound yarn: pirn winder twisted yarn: double twister | | | | rewinding: pirn winder twisted yarn: double twister | |
| | Twist direction | S | Z | S | Z | S | Z |
| | No. of twists (twist coefficient $\alpha$) | 800 (11,730) | | 800 (13,155) | | 800 (10,276) | |
| production conditions | Twist-setting temp. | 70 (° C.) (steam) | | | | | |
| Composite yarn characteristics | Elongation restoration CR (%) | 2.1 | 2.4 | 3.0 | 3.3 | 0.2 | 0.2 |
| | Cavity structure after boiling water treatment | formed | formed | formed | formed | not formed | not formed |
| Evaluation of woven | puffiness | ○ | ○ | ○ | ○ | × | × |
| | resilience | ○ | ○ | ○ | ○ | Δ | Δ |

TABLE 3-continued

| | | Example 11 | Example 12 | Example 13 | Example 14 | Comparative example 6 | Comparative example 7 |
|---|---|---|---|---|---|---|---|
| product (funcitonality) | lightweight | ○ | ○ | ○ | ○ | × | × |
| | stretchability | ○ | ○ | ○ | ○ | × | × |
| Properties of raw thread to be combined | Boiling yield (%) | 6.8 | | 7.5 | | | |
| | | | | constituent yarn 82.5dtex-18fil:8.0 87.5dtex-24fil(POY):0 | | | |

TABLE 4

| | | Example 15 | Example 16 | Example 17 | Example 18 | Comparative example 8 | Comparative example 9 |
|---|---|---|---|---|---|---|---|
| Conjugate multifilament yarn | | 50dtex-12fil | | 100dtex-24fil | | none | |
| Raw thread to be combined | | 165dtex-48fil (Z-twisted wooly-processed) | | 165dtex-48fil (Z-twisted wooly-processed) | | 165dtex-48fil (Z-twisted wooly-processed) | |
| Crimped composite yarn production conditions | Twisting method | multiple wound yarn: pirn winder twisted yarn: double twister | | | | rewinding: pirn winder twisted yarn: double twister | |
| | Twist direction | S | Z | S | Z | S | Z |
| | No. of twists (twist coefficient α) | 800 (11,730) | | 800 (13,023) | | 800 (10,276) | |
| | Twist-setting temp. (° C.) | 70 (steam) | | | | | |
| Composite yarn characteristics | Elongation restoration CR (%) | 4.6 | 14.4 | 3.0 | 12.5 | 0.2 | 0.2 |
| | Cavity structure after boiling water treatment | small | large | small | large | not formed | not formed |
| Evaluation of woven product (funcitonality) | puffiness | ○ | ◎ | ○ | ◎ | Δ | Δ |
| | resilience | ○ | ◎ | ○ | ◎ | Δ | Δ |
| | lightweight | ○ | ◎ | ○ | ◎ | × | × |
| | stretchability | ○ | ◎ | ○ | ◎ | × | × |

INDUSTRIAL APPLICABILITY

The present invention provides woven/knitted products with novel texture which have surface variations due to wrinkles produced over the surface of said woven/knitted products as well as dry touch properties and stretchability, said woven/knitted products being produced by carrying out a procedure wherein a polyester multifilament yarn comprising spun and drawn polyester polymer components with different heat-shrinking properties combined in parallel with each other or in a core-sheath configuration to provide a self-crimping yarn, followed by producing a woven/knitted product from said self-crimping yarn, and subjecting said product to relaxation treatment again in the dyeing process.

A woven/knitted product of the present invention is produced from a hollow yarn comprising a multifilament yarn with a cavity structure in its central portion, and as compared to conventional woven/knitted products produced by subjecting a conventional polyester multifilament yarn to additional twisting and weaving/knitting, said wovenJknitted products have better features including better lightweight properties, higher stretchability and higher resilience, which are most effectively displayed in such light clothing as shirts and blouses.

Furthermore, the invention provides a self-crimping composite yarn comprising conjugate filament yarn A which is produced from polyester polymer components with different heat-shrinking properties combined side by side or in a core-sheath configuration, and another polyester multifilament yarn B, wherein self-developed crimps are formed by crimp developing treatment in conjugate filament yarn A, which is located in a relatively inner position in said composite yarn, while said another polyester multifilament yarn B, after being combined together, is located in a relatively outer position in said composite yarn, allowing said crimped composite yarn and woven/knitted fabrics produced from said crimped composite yarn to incorporate a hollow structure and have hari (anti-drape stiffness), koshi (moderate stiffness),soft puffiness, and stretchability. Such woven/knitted fabrics ensures pleasant wearing when used as material for light clothing such as shirts and blouses as well as thick clothing such as suits, jackets, bottoms and coats, and are expected to have many new uses.

What is claimed is:

1. A self-crimping yarn comprising crimp-forming conjugate multifilaments wherein said crimp-forming conjugate multifilaments comprise at least two polyester polymer components having different heat shrinking properties, and said polyester polymer components are adhered in parallel with each other or in a core-sheath configuration, said self-crimping yarn having latent ability to develop additional crimps by making use of said different heat shrinkage properties, and wherein said self-crimping yarn having existing crimps (a) is able to make additional crimps (b) according to the following equations:

(a) 2.5 crests/cm≦number of crimps (CA)≦10 crests/cm, and (b) 8 crests/cm≦number of additionally developed crimps (CB)≦30 crests/cm.

2. A self-crimping yarn according to claim 1 wherein said self-crimping yarn has shrinkage stress, apparent shrinkage, and shrinkage percentage that meet the following equations (c)–(e):

(c) 0.0882≦shrinkage stress (TS) (cN/dtex)≦0.221, (d) 40%≦apparent shrinkage percentage (SC)≦80%, and (e) 2%≦shrinkage percentage in boiling water (SW) ≦8%.

3. Method of producing a self-crimping yarn according to claim 1, comprising the step of treating said crimp-forming conjugate multifilaments with relaxation heat-treatment.

4. A woven/knitted product which comprises said self-crimping yarn according to claim 1.

5. A woven/knitted product according to claim 4 wherein said self-crimping yarn comprises said crimp-forming conjugate multifilament yarn having a fineness of 30–350 dtex.

6. A woven/knitted product according to claim 4 wherein said crimp-forming conjugate multifilament yarn accounts for 35 wt % or more of the total yam weight.

7. A woven/knitted product according to claim 4 wherein crimps are developed by carrying out heat treatment to achieve shrinkage by 10% to 60% in the width and length directions to form a crimped yarn.

8. A woven/knitted product according to claim 7 wherein said crimped yam comprises a twisted spiral multifilament aggregate having hollow structures in its central portion.

9. A woven/knitted product comprising a yarn having a hollow structure, wherein said yarn comprises conjugate multifilaments with a twisted spiral multifilament aggregate, wherein its central portion comprises a hollow structure.

10. A woven/knitted product according to claim 9, wherein said yarn is a crimped yarn comprising said conjugate multifilaments with developed crimps.

11. A woven/knitted product according to claim 9, wherein said conjugate multifilament yarn comprises a hollow multifilament yarn further comprising multifilaments having hollow structures.

12. A woven/knitted product according to claim 9, wherein said conjugate multifilaments is twisted up to a twist coefficient $\alpha$ in the range of 3,000 to 30,000.

13. A composite yarn that is produced by twisting crimp-forming conjugate multifilament yarn A which consists of at least two polyester polymer components with different shrinkage properties and another polyester filament yarn B, wherein said composite yarn has a twisted spiral multifilament aggregate, and a hollow structure in its central portion.

14. A composite yarn according to claim 13 wherein said another polyester filament yarn B is a false-twisted polyester filament yarn.

15. A composite yarn according to claim 14 wherein said composite yarn is twisted in the opposite direction to that of the torque in said false-twisted polyester filament yarn B.

16. A composite yarn according to claim 13, wherein said composite yarn is twisted up to a twist coefficient $\alpha$ in the range of 3,000 to 30,000, said coefficient $\alpha$ being defined as:

$$\alpha = T \times D^{1/2}$$

where T and D represent the number of twists (twists/m) and the fineness of the composite yarn (dtex), respectively.

17. A composite yarn according to claim 13, wherein said twist coefficient $\alpha$ is in the range of 3,000 to 20,000.

18. A composite yarn according to claim 13, wherein said conjugate multifilament yarn A has a fineness of 30–350 dtex while said other polyester filament yarn B has a fineness of 30–800 dtex.

19. A composite yarn according to claim 13, wherein the weight ratio of said conjugate multifilament yarn A relative to the sum of conjugate multifilament yarn A and said other polyester filament yarn B meets the following equation:

$$0.2 \leqq A/(A+B) \leqq 0.8.$$

20. A composite yarn according to claim 13, wherein the number of developed crimps (CB) and the shrinkage stress (TS) of said conjugate multifilament yarn A meet the following equations:

$$8 \leqq CB\ (\text{crests/cm}) \leqq 30, \text{ and}$$

$$TS\ (g) \geqq 0.265\ \text{cN/dtex}.$$

21. A composite yarn that is produced by subjecting a composite yarn according to claim 13 to heat treatment to develop crimps.

22. A woven/knitted product comprising a composite yarn according to claim 13.

23. A woven/knitted product according to claim 10, wherein said crimped yarn comprising said conjugate multifilaments with developed crimps is obtained by applying additional crimps to the crimp-forming conjugate multifilaments, wherein said crimp-forming conjugate multifilaments further comprise at least two polyester polymer components having different heat-shrinking properties, and wherein said polyester polymer components are combined in parallel with each other or in a core-sheath configuration, and further wherein said additional crimps are developed by heat-relaxing said crimp-forming conjugate multifilaments.

24. A woven/knitted product according to claim 23, wherein said additional crimps are developed by carrying out heat treatment to achieve shrinkage by 10% to 60% in the width and length directions.

25. A composite yarn that is produced by twisting a crimp-forming conjugate multifilament yarn and another polyester filament yarn, wherein said crimp-forming conjugate multifilament yarn comprises said crimp-forming conjugate multifilaments of claim 1.

26. A composite yarn that is produced by twisting a crimp-forming conjugate multifilament yarn comprising multifilaments having at least two polyester polymer components with different heat-shrinking properties and another polyester filament yarn, wherein:

said polyester filament yarn is a false-twisted polyester filament yarn, said composite yarn has a twisted spiral multifilament aggregate and a hollow structure in its central portion, and said composite yarn is twisted in the opposite direction to that of the torque in said false-twisted polyester filament yarn.

27. A composite yarn according to claim 26, wherein:

said conjugate multifilament yarn has a fineness of 30–350 dtex while said another polyester filament yarn has a fineness of 30–800 dtex, the weight ratio of said conjugate multifilament yarn (CMY) relative to the sum of said conjugate multifilament yarn and said other polyester filament yarn (PFY) meets the following equation:

$$0.2 \leqq CMY/(CMY+PFY) \leqq 0.8; \text{ and}$$

the number of developed crimps (CB) and the shrinkage stress (TS) of said conjugate multifilament yarn meet the following equations:

$$8 \leqq CB\ (\text{crests/cm}) \leqq 30, \text{ and}$$

$$TS\ (g) \leqq 0.265\ \text{cN/dtex}.$$

* * * * *

UNITED STATES PATENT AND TRADEMARK OFFICE

CERTIFICATE OF CORRECTION

PATENT NO. : 6,276,121 B1
DATED : August 21, 2001
INVENTOR(S) : Nabeshima et al.

It is certified that error appears in the above-identified patent and that said Letters Patent is hereby corrected as shown below:

Title page,
Item [57], please substitute the ABSTRACT with the following:
-- Conjugate yarn having unique surface texture, dry touch, and stretchability; having multifilaments including at least two polyester polymer components; and
(a) number of crimps (CA): 2.5 crests/cm $\leq$ CA $\leq$ 10 crests/cm,
(b) number of developed crimps (CB): 8 crests/cm CB $\leq$ 30 crests/cm,
(c) shrinkage stress (TS): 0.0882 $\leq$ TS (cN/dtex) $\leq$ 0.221,
(d) apparent shrinkage percentage (SC): 40% $\leq$ SC $\leq$ 80%, and
(e) shrinkage percentage in boiling water (SW): 2% $\leq$ SW $\leq$ 8%. --

Column 4,
Line 46, please change "a" second occurrence to -- $\propto$ --.

Column 7,
Line 15, please delete "the" second occurrence.

Signed and Sealed this

First Day of October, 2002

*Attest:*

*Attesting Officer*

JAMES E. ROGAN
*Director of the United States Patent and Trademark Office*